US006260958B1

(12) United States Patent
Yoshihira et al.

(10) Patent No.: US 6,260,958 B1
(45) Date of Patent: Jul. 17, 2001

(54) LIQUID EJECTION HEAD HAVING SPECIFIC FLOW PATH STRUCTURE

(75) Inventors: Aya Yoshihira; Kouji Yamakawa, both of Yokohama; Tsuyoshi Orikasa, Musashimurayama; Hiroyuki Ishinaga, Tokyo; Toshio Kashino, Chigasaki; Hiroyuki Kigami, Yokohama; Kimiyuki Hayasaki, Yokohama; Hisashi Fukai, Yokohama; Kiyomitsu Kudo; Takayuki Ono, both of Kawasaki; Yoshie Asakawa, Nagano-ken; Masayoshi Ohkawa, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/617,257

(22) Filed: Jul. 14, 2000

Related U.S. Application Data

(62) Division of application No. 08/871,380, filed on Jun. 9, 1997, now Pat. No. 6,168,264.

(30) Foreign Application Priority Data

Jun. 7, 1996 (JP) ..... 8-145684
Jun. 7, 1996 (JP) ..... 8-145685
Jul. 12, 1996 (JP) ..... 8-203144

(51) Int. Cl.[7] ..... B41J 2/05
(52) U.S. Cl. ..... 347/65
(58) Field of Search ..... 347/56, 65, 84, 347/85, 63

(56) References Cited

U.S. PATENT DOCUMENTS

| | | | |
|---|---|---|---|
| 4,480,259 | 10/1984 | Kruger et al. . | |
| 4,723,129 | 2/1988 | Endo et al. . | |
| 5,208,604 | 5/1993 | Watanabe et al. . | |
| 5,278,585 | 1/1994 | Karz et al. . | |
| 5,657,539 | 8/1997 | Orikasa et al. | 29/890.1 |
| 5,821,962 | 10/1998 | Kudo | 347/65 |
| 5,943,074 | 8/1999 | Kashino et al. | 347/54 |
| 6,084,616 * | 7/2000 | Nakata et al. | 347/65 |
| 6,102,529 * | 8/2000 | Okazaki et al. | 347/65 |
| 6,142,613 * | 11/2000 | Asakawa et al. | 347/65 |
| 6,154,237 * | 11/2000 | Kashino et al. | 347/48 |
| 6,168,264 * | 1/2001 | Yoshihira et al. | 347/65 |

FOREIGN PATENT DOCUMENTS

| | | |
|---|---|---|
| 0 737 582 | 10/1995 | (EP) . |
| 0 721 842 | 7/1996 | (EP) . |
| 55-81172 | 6/1980 | (JP) . |
| 61-19372 | 1/1986 | (JP) . |
| 61-69467 | 4/1986 | (JP) . |
| 63-199972 | 8/1988 | (JP) . |
| 3-234538 | 10/1991 | (JP) . |
| 3-292146 | 12/1991 | (JP) . |
| 5-124189 | 5/1993 | (JP) . |

* cited by examiner

*Primary Examiner*—Robert Beatty
(74) *Attorney, Agent, or Firm*—Fitzpatrick, Cella, Harper & Scinto

(57) ABSTRACT

A liquid ejection head includes an ejection outlet for ejecting liquid; a plurality of liquid flow paths; a bubble generating region for generating a bubble; a movable member disposed faced to the bubble generating region and movable between a first position and a second position which is farther from the bubble generating region than the first position; wherein the movable member moves from the first position to the second position by pressure produced by the generation of the bubble to permit expansion of the bubble more in a downstream side closer to the ejection outlet than in an upstream side. In addition, a first common liquid chamber having a height, measured in a direction perpendicular to a plane including the movable member at rest, which is larger than that of the liquid flow paths, wherein the movable member has a fulcrum in the first common liquid chamber and a free end in the liquid flow paths.

74 Claims, 26 Drawing Sheets

(a)

(b)

(a)

(b)

LIQUID EJECTION HEAD HAVING SPECIFIC FLOW PATH STRUCTURE

This application is a divisional of Ser. No. 08,871,380 filed Jun. 9, 1997 Ser. No.6,168,264.

FIELD OF THE INVENTION AND RELATED ART

The present invention relates to a liquid ejecting head wherein liquid is ejected by generation of a bubble created by application of thermal energy to the liquid, more particularly to such a head having a movable member displaced by the generation of the bubble.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129 and so on, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, adjustment of a thickness of a protecting film is considered to optimize the heat generating element to meet the demand for the improvement in the ejection efficiency. This method is effective in that propagation efficiency of the generated heat to the liquid is improved.

In order to provide high quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 and so on discloses a flow passage structure shown in FIG. 6, (*a*), (*b*). The flow passage structure or the head manufacturing method disclosed in this publication has been made noting a backward wave (the pressure wave directed away from the ejection outlet, more particularly, toward a liquid chamber 12) generated in accordance with generation of the bubble.

FIG. 6, (*a*) and (*b*) disclose a valve 10 spaced from a generating region of the bubble generated by the heat generating element 2 in a direction away from the ejection outlet 11.

In FIG. 6, (*b*), the valve 55 is manufactured from a plate and has an initial position as if it is stuck on the ceiling of the liquid flow path 10. It lowers into the liquid flow path 10 by generation of the bubble.

Japanese Laid Open Patent Application No. SHO-63-199972 discloses a head wherein refilling of the recording liquid is improvement so that frequency responsivity is high.

On the other hand, in the bubble jet recording method, the heating is repeated with the heat generating element contacted with the ink, and therefore, a burnt material is deposited on the surface of the heat generating element due to burnt deposit of the ink. However, the amount of the deposition may be large depending on the materials of the ink. If this occurs, the ink ejection becomes unstable. Additionally, even when the liquid to be ejected is the one easily deteriorated by heat or even when the liquid is the one with which the bubble generated is not sufficient, the liquid is desired to be ejected in good order without property change.

Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to a quite high degree. In addition, the deformation of the flexible film is not so large, and therefore, the energy use efficiency and the ejection force are deteriorated although the some effect is provided by the provision between the ejection liquid and the bubble generation liquid.

Further improvement of liquid ejecting head is desired.

SUMMARY OF THE INVENTION

It is an object of the present invention to provide a liquid ejecting head wherein back wave is suppressed by a valve mechanism of a movable member, and a resistance applied to the ejection liquid by the liquid flow path is reduced to improve the refilling performance.

It is another object of the present invention to provide a liquid ejecting head or the like wherein an inertia, due to a backward wave, in a direction opposite from the liquid supply direction is suppressed, and simultaneously therewith, a meniscus retraction amount is reduced by a valve function of a movable member, so that refilling frequency is increased, and therefore, the printing speed or the like is improved.

It is a further object of the present invention to provide a liquid ejecting head wherein when the valve mechanism of the movable member operates by the generation of the bubble, the resistance applied by the liquid flow path is reduced to improve the ejection efficiency.

It is a further object of the present invention to provide a liquid ejecting head wherein the heat accumulation in the liquid on the heat generating element is significantly reduced, and the residual bubble on the heat generating element can be reduced, while the ejection efficiency and the ejection pressure are improved.

It is a further object of the present invention to provide a liquid ejecting head and so on wherein deposition of residual material on the heat generating element is reduced, and the range of the usable liquid is widened, and in addition, the ejection efficiency and the ejection force are significantly increased.

It is a further object of the present invention to provide a liquid ejecting method, a liquid ejecting head and so on, wherein the choice of the liquid to be ejected is made greater.

It is a further object of the present invention to provide a manufacturing method for a liquid ejecting head with which such a liquid ejecting head is easily manufactured.

It is a further object of the present invention to provide an inexpensive liquid ejecting head and a manufacturing method therefor wherein the number of parts constituting the liquid ejecting head is small.

According to an aspect of the present invention, there is provided a liquid ejection head comprising: an ejection outlet for ejecting liquid; a bubble generating region for generating a bubble; a movable member disposed faced to the bubble generating region and movable between a first position and a second position which is farther form the bubble generating region than the first position; wherein the movable member moves from the first position to the second position by pressure produced by the generation of the bubble to permit expansion of the bubble more in a downstream side closer to the ejection outlet than in an upstream side; and a first common liquid chamber having a height, measured in a direction perpendicular to a plane including the movable member at rest, which is larger than that of the first liquid flow path, wherein the movable member has a fulcrum in the first common liquid chamber and a free end in the first liquid flow path.

According to another aspect of the present invention, there is provided a liquid ejection head comprising: an ejection outlet for ejecting liquid; a liquid path having a heat generating element for generating a bubble in the liquid by application of heat to the liquid, and a supply passage for supplying the liquid to the heat generating element from upstream side thereof; a movable member, disposed faced to the heat generating element and having a free end adjacent the ejection outlet, for directing a pressure produced by generation of the bubble, toward the ejection outlet, on the basis of the pressure produced by the generation of the bubble; and a first common liquid chamber having a height, measured in a direction perpendicular to a plane including the movable member at rest, which is larger than that of the first liquid flow path, wherein the movable member has a fulcrum in the first common liquid chamber and a free end in the first liquid flow path.

According to a further aspect of the present invention, there is provided a liquid ejection head comprising: an ejection outlet for ejecting liquid; a heat generating element for generating a bubble in the liquid by application of heat to the liquid; a movable member, disposed faced to the heat generating element and having a free end adjacent the ejection outlet, for directing a pressure produced by generation of the bubble, toward the ejection outlet; a supply passage for supplying the liquid to the heat generating element from an upstream thereof along a surface of the movable member adjacent the heat generating element; a first common liquid chamber having a height, measured in a direction perpendicular to a plane including the movable member at rest, which is larger than that of the first liquid flow path, wherein the movable member has a fulcrum in the first common liquid chamber and a free end in the first liquid flow path.

According to a further aspect of the present invention, there is provided a liquid ejection head comprising: a first liquid flow path in fluid communication with an ejection outlet; a second liquid flow path having bubble generation region for generating the bubble in the liquid by applying heat to the liquid; a movable member, disposed between the first liquid flow path and the bubble generating region and having a free end adjacent the ejection outlet, for directing a pressure produced by generation of the bubble, toward the ejection outlet of the first liquid flow path, by movement of the free end into the first liquid flow path on the basis of pressure produced by generation of the bubble the bubble generating region; a first common liquid chamber having a height, measured in a direction perpendicular to a plane including the movable member at rest, which is larger than that of the first liquid flow path, wherein the movable member has a fulcrum in the first common liquid chamber and a free end in the first liquid flow path.

According to a further aspect of the present invention, there is provided a plurality of grooves for constituting a plurality of first liquid flow paths in direct fluid communication with associated ones of the ejection outlets; a recess for constituting a first common liquid chamber for supplying the liquid to the first liquid flow paths; wherein the grooves and the recess are formed in a grooved member; an element substrate having a plurality of heat generating elements for generating the bubble in the liquid by applying heat to the liquid; and a partition wall disposed between the grooved member and the element substrate and forming a part of walls of second liquid flow paths corresponding to the heat generating elements, and a movable member movable into the first liquid flow paths by pressure produced by the generation of the bubble, the movable member being faced to the heat generating element; and a first common liquid chamber having a height, measured in a direction perpendicular to a plane including the movable member at rest, which is larger than that of the first liquid flow path, wherein the movable member has a fulcrum in the first common liquid chamber and a free end in the first liquid flow path.

According to an aspect of the present invention, the fulcrum of the movable member is placed in the first common chamber, so that resistance against the displacement of the movable member by the ceiling wall of the ejection flow path can be minimized.

Since the first liquid flow path is short so that flow path resistance against the ejection liquid is small, by which height viscosity recording liquid which has been difficult to eject heretofore, can be ejected.

In an aspect of improving the refilling property, the responsivity, the stabilized growth of the bubble and stabilization of the liquid droplet during the continuous ejections are accomplished, thus permitting high speed recording. The ejection efficiency can be improved as compared with a conventional bubble jet type ejection head since the liquid adjacent to the ejection outlet can be efficiently ejected by the synergistic effect between the generated bubble and the movable member displacement thereby. For example, in the most desirable type of the present invention, the ejection efficiency is increased even to twice the conventional one.

In another aspect of the present invention, even if the printing operation is started after the recording head is left in a low temperature or low humidity condition for a long term, the ejection failure can be avoided. Even if the ejection failure occurs, the normal operation is recovered by a small scale recovery process including a preliminary ejection and sucking recovery.

These and other objects, features and advantages of the present invention will become more apparent upon a consideration of the following description of the preferred embodiments of the present invention taken in conjunction with the accompanying drawings.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly function to eject the liquid droplet. More particularly, it generally means a downstream from the center of the bubble with respect to the direction of the general liquid flow, or a downstream from the center of the area of the heat generating element with respect to the same.

In this specification, "substantially sealed" generally means a sealed state in such a degree that when the bubble grows, the bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

In this specification, "comb" or "comb-like" means a structure in which the fulcrum portions of the movable member is common, but the free end portions are open.

DESCRIPTION OF THE PREFERRED EMBODIMENTS

Second bubble generation step of generating at least one other bubble in said bubble generating region to eject the liquid through the ejection outlet.

Referring the accompanying drawings, the ejection principle used in the present invention will be described.

Figure 1:
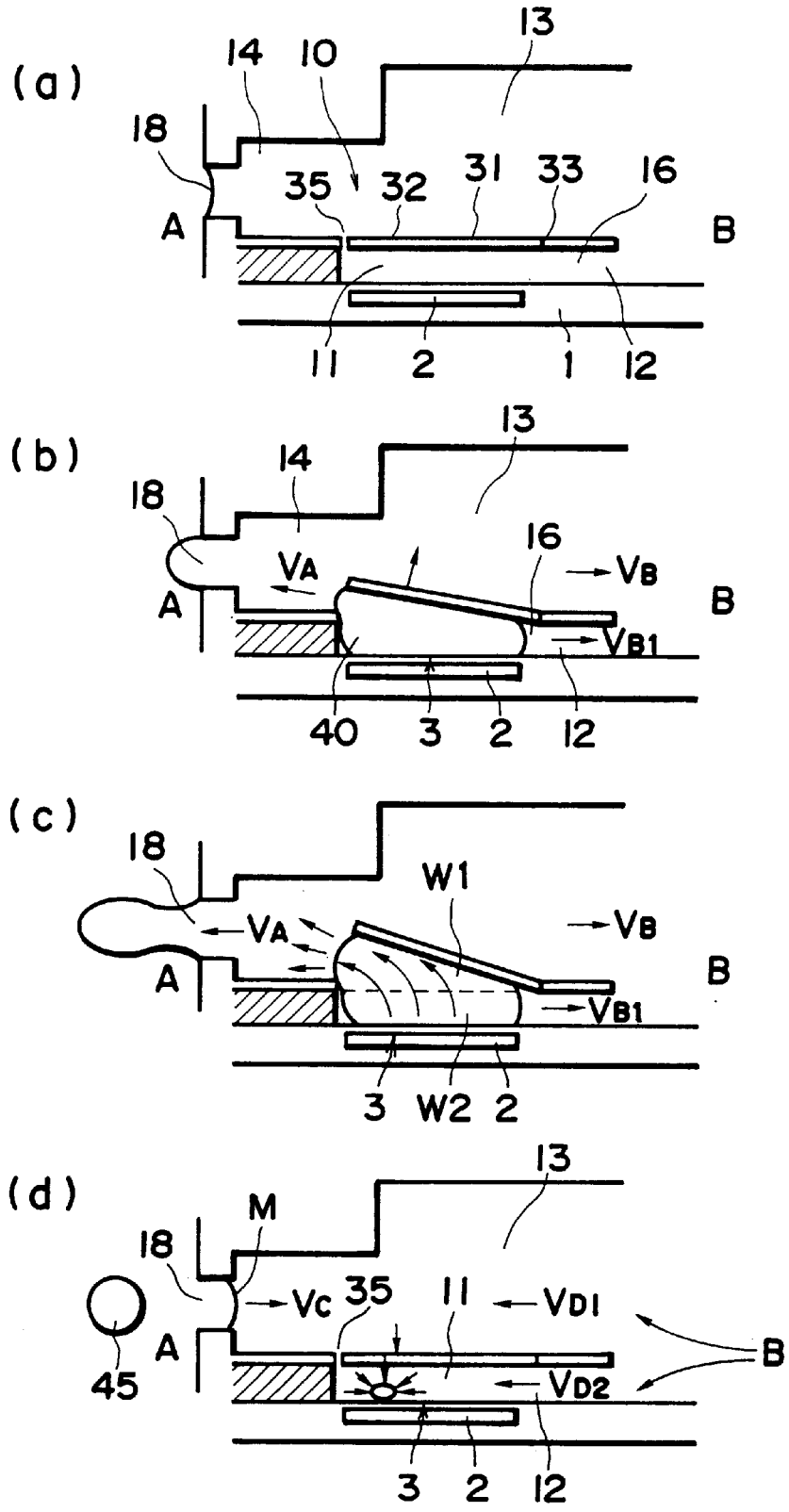
FIGS. 1(*a*)–1(*d*) are schematic sectional view showing an example of a liquid ejecting head according to an embodiment of the present invention.
Figure 3:
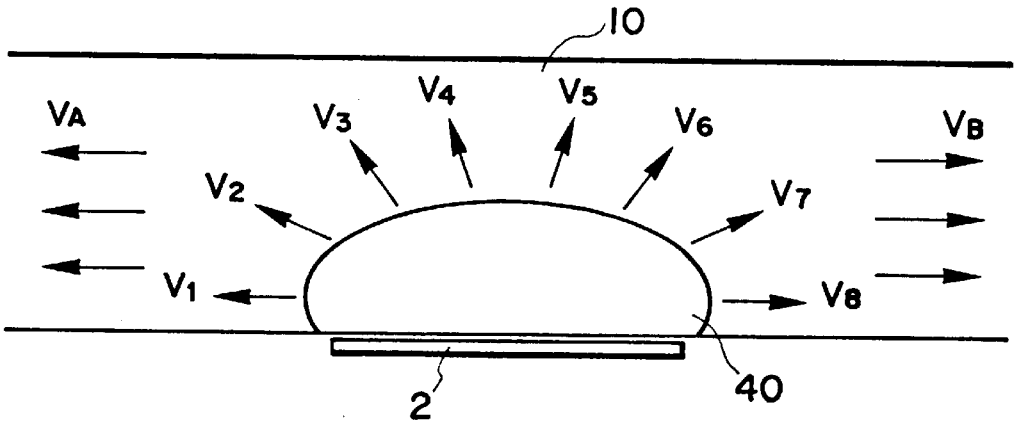
FIG. 3 is a schematic view showing pressure propagation from a bubble in a conventional head.

FIG. 1 is a schematic sectional view of a liquid ejecting head taken along a liquid flow path according to this embodiment, and FIG. 3 is a partly broken perspective view of the liquid ejecting head.

The liquid ejecting head of this embodiment comprises a heat generating element 2 (comprising a first heat generating element 2A and a second heat generating element 2B and having a dimension of 40 $\mu$m×105 $\mu$m as a whole in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18, respectively.

Above the element substrate in the liquid flow path 10, a movable member or plate 31 in the form of a cantilever of an elastic material such as metal is provided faced to the heat generating element 2. One end of the movable member is fixed to a foundation (supporting member) or the like provided by patterning of photosensitivity resin material on the wall of the liquid flow path 10 or the element substrate. By this structure, the movable member is supported, and a fulcrum (fulcrum portion) 33 is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and so that it has a free end (free end portion) 32 in a downstream side of the fulcrum 33. The movable member 31 is faced to the heat generating element 2 with a gap of 15 $\mu$m approx. as if it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

Figure 2:
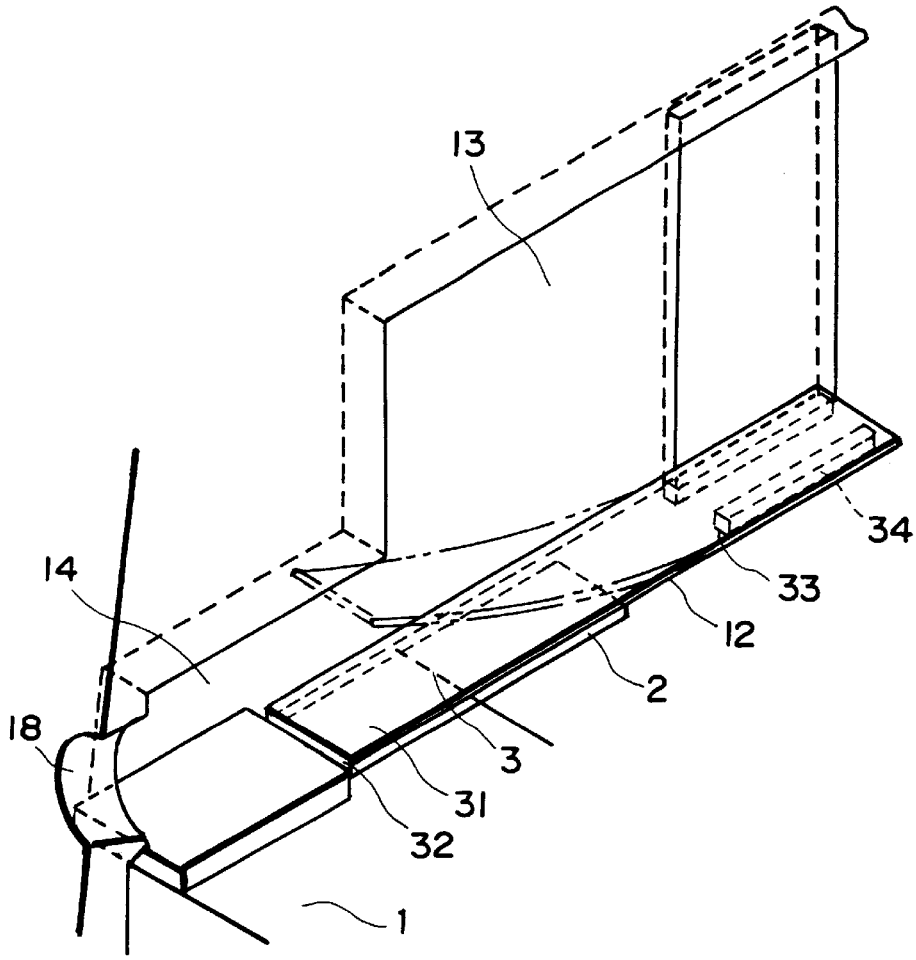
FIG. 2 is a partly broken perspective view of a liquid ejecting head according to an embodiment of the present invention.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that movable member 31 moves or displaces to widely open toward the ejection outlet side about the fulcrum 33, as shown in FIG. 2, (*b*) and (*c*) or in FIG. 2. By the displacement of the movable member 31 or the state after the displacement, the propagation of the pressure caused by the generation of the bubble and the growth of the bubble per se are directed toward the ejection outlet.

The description will be made as to one of fundamental ejection principle usable with the present invention. One of important principles of this invention is that movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble and/or the growth of the bubble per se toward the ejection outlet 18 (downstream).

Figure 4:
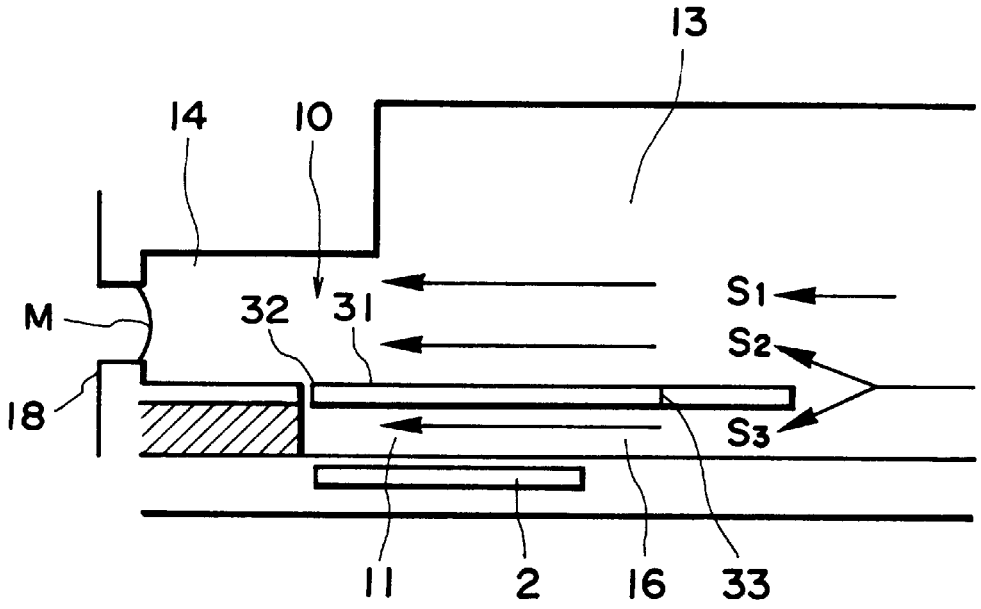
FIG. 4 is a schematic view showing pressure propagation from a bubble in a head according to an embodiment of the present invention.
Figure 5:
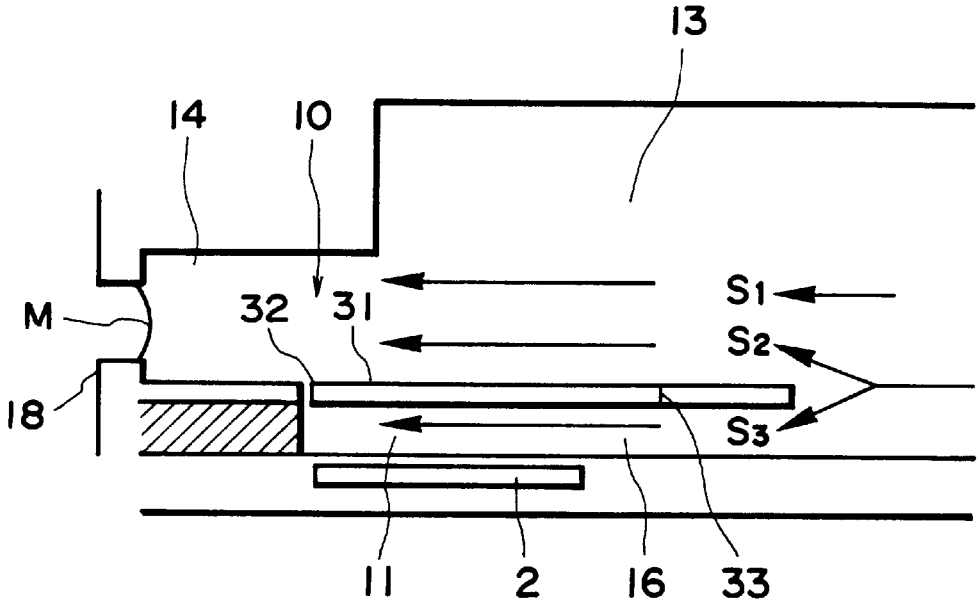
FIG. 5 is a schematic view illustrating flow of liquid in an embodiment of the present invention.

More detailed description will be made with comparison between the conventional liquid flow passage structure not using the movable member (FIG. 4) and the present invention (FIG. 5). Here, the direction of propagation of the pressure toward the ejection outlet is indicated by VA, and the direction of propagation of the pressure toward the upstream is indicated by VB.

In a conventional head as shown in FIG. 3, there is not any structural element effective to regulate the direction of the propagation of the pressure produced by the bubble 40 generation. Therefore, the direction of the pressure propagation of the is normal to the surface of the bubble as indicated by V1–V8, and therefore, is widely directed in the passage. Among these directions, those of the pressure propagation from substantially the half portion of the bubble closer to the ejection outlet (V1–V4), have the pressure components in the $V_A$ direction which is most effective for the liquid ejection. This portion is important since it is directly contributable to the liquid ejection efficiency, the liquid ejection pressure and the ejection speed. Furthermore, the component V1 is closest to the direction of $V_A$ which is the ejection direction, and therefore, the component is most effective, and the V4 has a relatively small component in the direction $V_A$.

On the other hand, in the case of the present invention, shown in FIG. 5, the movable member 31 is effective to direct, to the downstream (ejection outlet side), the pressure propagation directions V1–V4 of the bubble which otherwise are toward various directions. Thus, the pressure propagations of bubble 40 are concentrated so that pressure of the bubble 40 is directly and efficiently contributable to the ejection. The growth direction per se of the bubble is directed downstream similarly to the pressure propagation directions V1–V4, and the bubble grows more in the downstream side than in the upstream side. Thus, the growth direction per se of the bubble is controlled by the movable member, and the pressure propagation direction from the bubble is controlled thereby, so that ejection efficiency, ejection force and ejection speed or the like are fundamentally improved.

Referring back to FIG. 1, the description will be made as to ejecting operation in the liquid ejecting head of this embodiment.

Figure 12:
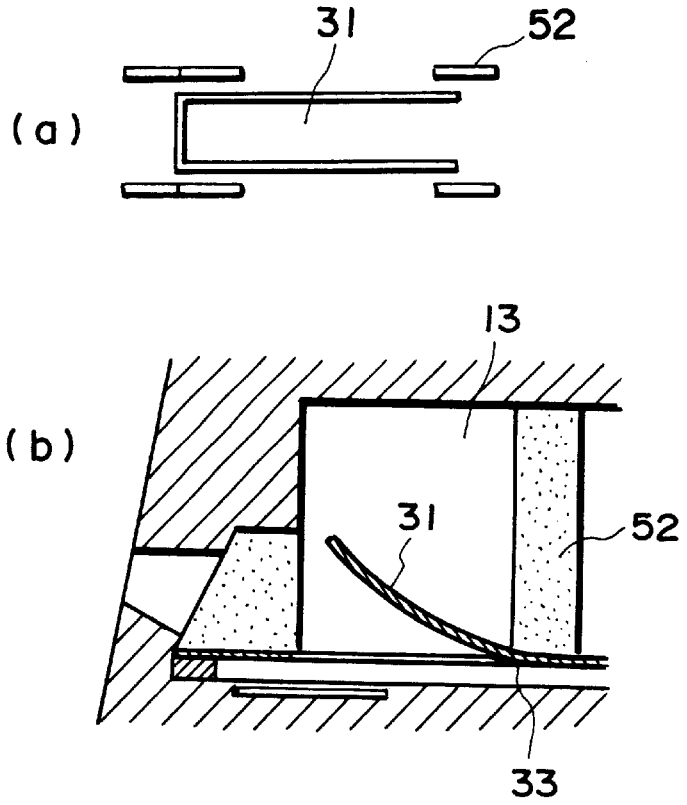
FIGS. 12(*a*) and 12(*b*) are schematic sectional views of a liquid ejecting head according to an embodiment of the present invention.

FIG. 12, (*a*) shows a state before the energy such as electric energy is applied to the heat generating element 2, and therefore, no heat has yet been generated. It should be noted that movable member 31 is so positioned as to be faced at least to the downstream portion of the bubble generated by the heat generation of the heat generating element. In other words, in order that downstream portion of the bubble acts on the movable member, the liquid flow passage structure is such that movable member 31 extends at least to the position downstream (downstream of a line passing through the center 3 of the area of the heat generating element and perpendicular to the length of the flow path) of the center 3 of the area of the heat generating element.

FIG. 1, (*b*) shows a state wherein the heat generation of heat generating element 2 occurs by the application of the electric energy to the heat generating element 2, and a part of the liquid filled in the bubble generation region 11 is heated by the thus generated heat so that bubble is generated as a result of film boiling.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 1, (*c*) shows a state in which the bubble 40 has further grown by the pressure resulting from the bubble 40 generation, the movable member 31 is displaced further. The generated bubble grows more downstream than upstream, and it expands greatly beyond a first position (broken line position) of the movable member. Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 1, (*d*) shows the bubble 40 contracting and extinguishing by the decrease of the internal pressure of the bubble after the film boiling.

The movable member 31 having been displaced to the second position returns to the initial position (first position) of FIG. 2, (*a*) by the restoring force provided by the spring property of the movable member per se and the negative pressure due to the contraction of the bubble. Upon the collapse of bubble, the liquid flows back from the common liquid chamber side as indicated by $VD_1$ and $VD_2$ and from the ejection outlet side as indicated by $V_c$ so as to compensate for the volume reduction of the bubble in the bubble generation region 11 and to compensate for the volume of the ejected liquid.

In the foregoing, the description has been made as to the operation of the movable member 31 with the generation of the bubble and the ejecting operation of the liquid. Now, the description will be made as to the refilling of the liquid in the liquid ejecting head of the present invention.

When the bubble 40 enters the bubble collapsing process after the maximum volume thereof (FIG. 2, (*c*)), a volume of the liquid enough to compensate for the collapsing bubbling volume flows into the bubble generation region from the ejection outlet 18 side of the first liquid flow path 14 and from the bubble generation region of the second liquid flow path 16. In the case of conventional liquid flow passage structure not having the movable member 31, the amount of the liquid from the ejection outlet side to the bubble collapse position and the amount of the liquid from the common liquid chamber thereinto, correspond to the flow resistances of the portion closer to the ejection outlet than the bubble generation region and the portion closer to the common liquid chamber (flow path resistances and the inertia of the liquid).

Therefore, when the flow resistance at the ejection outlet side is small, a large amount of the liquid flows into the bubble collapse position from the ejection outlet side, with the result that meniscus retraction is large. With the reduction of the flow resistance in the ejection outlet for the purpose of increasing the ejection efficiency, the meniscus retraction increases upon the collapse of bubble with the result of longer refilling time period, thus making high speed printing difficult.

According to this embodiment, because of the provision of the movable member 31, the meniscus retraction stops at the time when the movable member returns to the initial position upon the collapse of bubble, and thereafter, the supply of the liquid to fill a volume W2 is accomplished by the flow through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream of the second liquid flow path along the surface of the heat generating element side of the movable member 31 using the pressure upon the collapse of bubble, and therefore, more speedy refilling action is accomplished.

When the high speed refilling using the pressure upon the collapse of bubble is carried out in a conventional head, the vibration of the meniscus is expanded with the result of the deterioration of the image quality. However, according to this embodiment, the flows of the liquid in the first liquid flow path 14 at the ejection outlet side and the ejection outlet side of the bubble generation region 11 are suppressed, so that vibration of the meniscus is reduced.

Thus, according to this embodiment, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The embodiment provides the following effective function, too. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the inertia force. In this embodiment, these actions to the upstream side are suppressed by the movable member 31, so that refilling performance is further improved.

Additional description will be made as to the structure and effect in the present invention.

With this structure, the supply of the liquid to the surface of the heat generating element 2 and the bubble generation region 11 occurs along the surface of the movable member 31 at the position closer to the bubble generation region 11. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not extinguished are removed without difficulty, and in addition, the heat accumulation in the liquid is not too much. Therefore, more stabilized generation of the bubble can be repeated at high speed. In this embodiment, the liquid supply passage 12 has a substantially flat internal wall, but this is not limiting, and the liquid supply passage is satisfactory if it has an internal wall with such a configuration smoothly extended from the surface of the heat generating element that stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 2. Then, the flow resistance for the liquid between the bubble generation region 11 and the region of the first liquid flow path 14 close to the ejection outlet is increased by the restoration of the movable member to the first position, so that flow of the liquid to the bubble generation region 11 along $V_{D1}$ can be suppressed. However, according to the head structure of this embodiment, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 8:
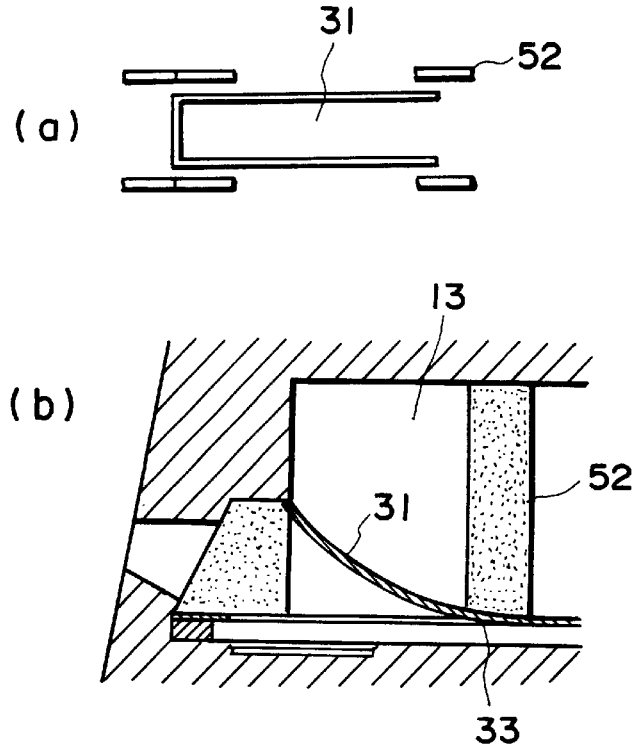
FIGS. 8(*a*) and 8(*b*) are schematic sectional views of a liquid ejecting head according to an embodiment of the present invention.

The positional relation between the free end 32 and the fulcrum 33 of the movable member 31 is such that free end is at a downstream position of the fulcrum as shown in FIG. 8, for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted b the ejection as shown in FIG. 8, returns to the ejection outlet 18 by capillary force or when the liquid supply is effected to compensate for the collapse of bubble, the positions of the free end and the fulcrum 33 are such that flows $S_1$, $S_2$ and $S_3$ through the liquid flow path 10 including the first liquid flow path 14 and the second liquid flow path 16, are not impeded.

More particularly, in this embodiment, as described hereinbefore, the free end 32 of the movable member 3 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble which are greatly contributable to the ejection of the liquid at the downstream side of the area center position 3 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 31, contributes to the ejection of the liquid.

Embodiment 1

The liquid ejection principle in this embodiment is the same as the principle described above. In this embodiment and thereafter, the present invention is described with reference to a head in which the first and second liquid flow paths 14 and 16 are separated with the separation wall 30. However, the present invention is not limited to this type of head; it is also applicable to those heads mentioned in the preceding description of liquid ejection principle.

The head structure in this embodiment is characterized by the following function, in addition to those described above. That is, the flow resistance of the first liquid flow path 14 is minimized to refill the liquid at a higher speed. According to this embodiment, the upstream side end of the first liquid flow path 14 is on the ejection outlet side of the free end of the movable member 31 having moved to the second position, since the pressure which tends to wastefully dissipate can be directed toward the ejection outlet side by the movable member 31, as described above. With the implementation of this structure, the repulsive force which the movable member 31 receives as it moves to the second position can be reduced.

Hereinafter, the structure and effects which characterize this embodiment will be described.

Figure 7:
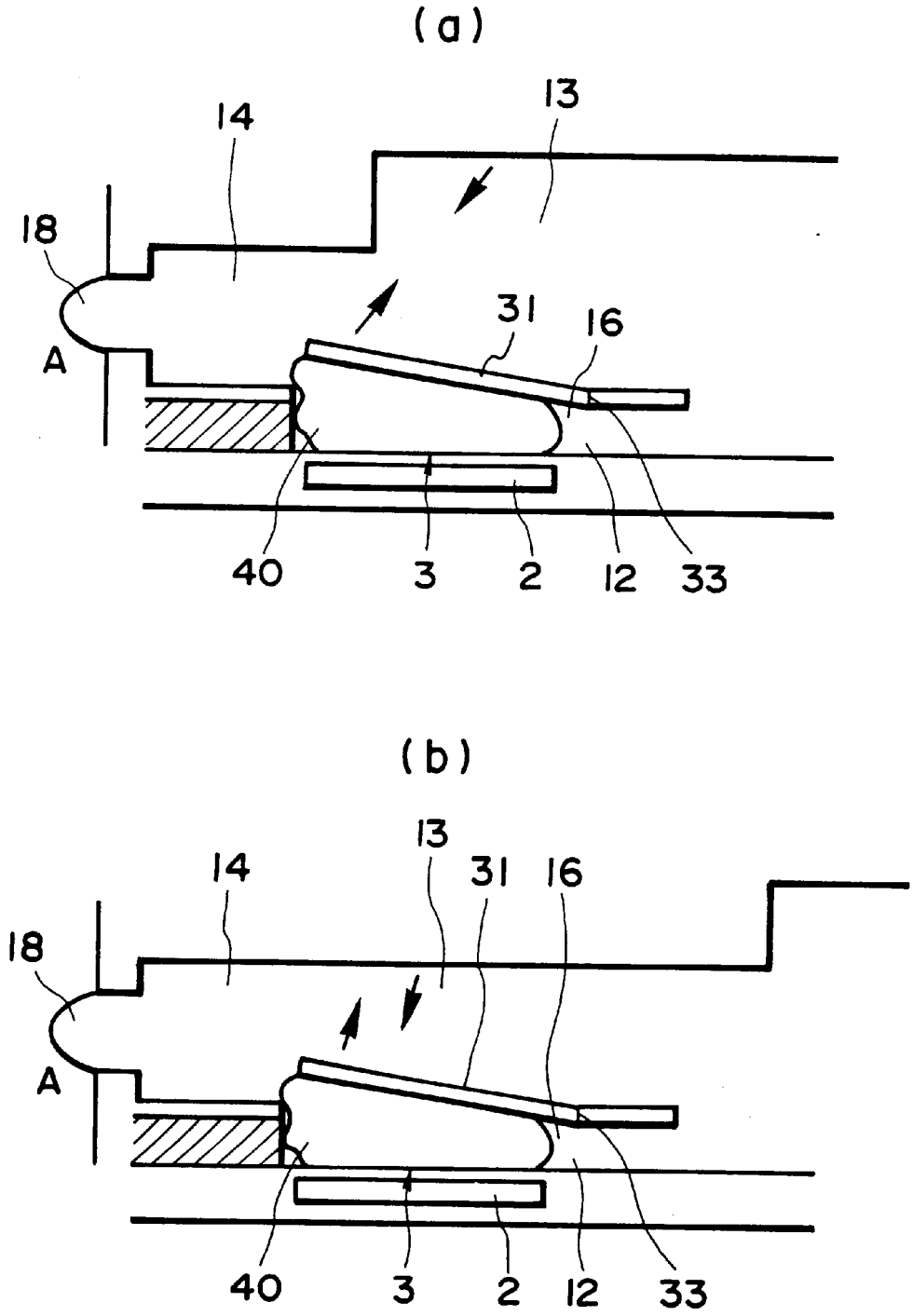
FIGS. 7(*a*) and 7(*b*) are a schematic sectional views showing force applied from the ceiling of the liquid flow path to the movable member in a liquid ejecting head according to the Present invention.

FIG. 7 depicts the effect of the ceiling of the first liquid flow path 14 upon the pivotal displacement of the movable member 31. In FIG. 7, (*a*), the upstream side end of the first liquid flow path 14 is on the downstream side of the position to which the free end of the movable member reaches as the movable member 31 moves to the second position, and in FIG. 7, (*b*), the upstream side end of the first liquid flow path 14 is on the upstream side of the supporting point 33 of the movable member 31. As the movable member 31 moves toward the second position, it is subjected to the repulsive force, that is, the force which works in the direction opposite to the direction in which the movable member 31 moves, from the ceiling of the common liquid chamber 13 or first liquid flow path 14. This is why it is desirable that the upstream side end of the first liquid flow path 14 is on the downstream side of the position to which the free end of the movable member 13 reaches as the movable member 13 moves to the second position.

FIGS. 8–12 show the positional relationship among the movable member 13, first liquid flow path, and common liquid chamber 13, wherein in each figure, (a) is a horizontal section of the nozzle portion as seen from the first liquid flow path side, depicting the positional relationship among the movable member 31, first liquid flow path 14, a post 52 to which the supporting point 33 of the movable member 13 is fixed, and the side walls 53 of the first liquid flow path 14, and (b) is a vertical section of the nozzle portion, depicting the configuration of the side wall 53 of the first liquid flow path 14.

FIG. 8 shows the structure of a nozzle in which the downstream side end of the first common liquid chamber 13 is on the upstream side of the position to which the free end of the movable member 31 reaches as the movable member 31 moves to the second position, and which has a post 52 to which the supporting point of the movable member 31 is fixed.

With this structure, the repulsive force which comes from the ceiling as the movable member 31 is pivotally displaced is negligible, and therefore, the power from bubble generation can be efficiently converted into ejective force. It should be noted here that when a certain type of material is used as the material for the movable member 31, the supporting point 33 of the movable member 31 may be lifted into the first common liquid chamber 33, and as a result, the movable member 31 in a nozzle may be affected by the movement of the movable member 31 in the adjacent nozzles. Therefore, it is desirable that the supporting point 33 of the movable member 31 is fixed as described in this embodiment.

Figure 9:
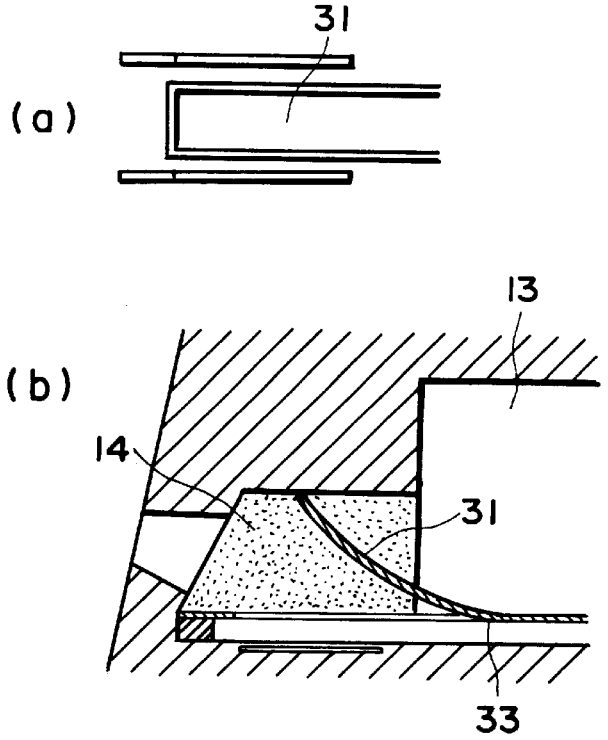
FIGS. 9(*a*) and 9(*b*) are schematic sectional views of a liquid ejecting head according to an embodiment of the present invention.
Figure 13:
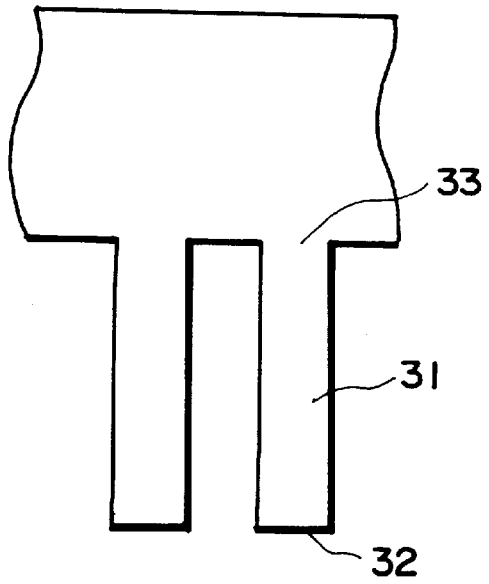
FIG. 13 illustrates a comb-like movable member.

FIG. 9 depicts a nozzle in which the upstream side end of the first liquid flow path 14 is on the further upstream side of the position to which the free end of the movable member 31 reaches as the movable member 31 is pivotally displaced, compared to the preceding nozzle. In this case, the supporting point 33 of the movable member 31 is also in the first common liquid chamber 33, but is not fixed. Yet, the arrangement is effective to improve the liquid refilling efficiency as well as the liquid ejection efficiency. This arrangement is also effective in the case of a liquid ejection head illustrated in FIG. 13, in which the bubble generation liquid and ejection liquid are the same liquid, and the movable member 31 is formed like a tooth of a comb.

Figure 10:
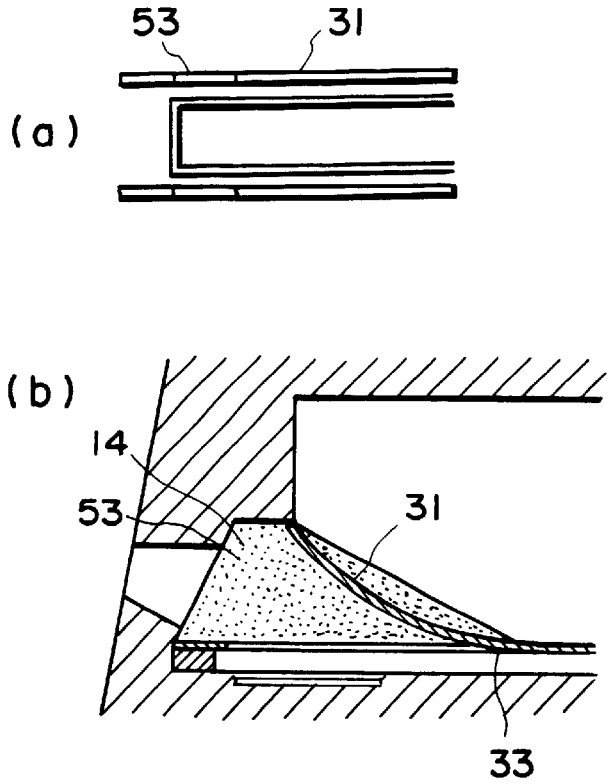
FIGS. 10(*a*) and 10(*b*) are schematic sectional views of a liquid ejecting head according to an embodiment of the present invention.

FIG. 10 depicts a liquid ejection head in which the ceiling of the first liquid flow path 14 becomes abruptly higher on the upstream side of the position to which the free end of the movable member 31 reaches as the movable member 31 is moved to the second position, and the side wall 53 of the first liquid flow path 14, which separates the adjacent two nozzles, vertically extends as high as the straight line connecting the point at which the free end of the movable member 31 is when the movable member 31 is at the second position, and the supporting point 33.

This structural arrangement is effective to prevent a bubble from expanding in the horizontal direction, and therefore, the power from bubble generation can be converted into elective force more effectively than in the preceding arrangement.

Figure 11:
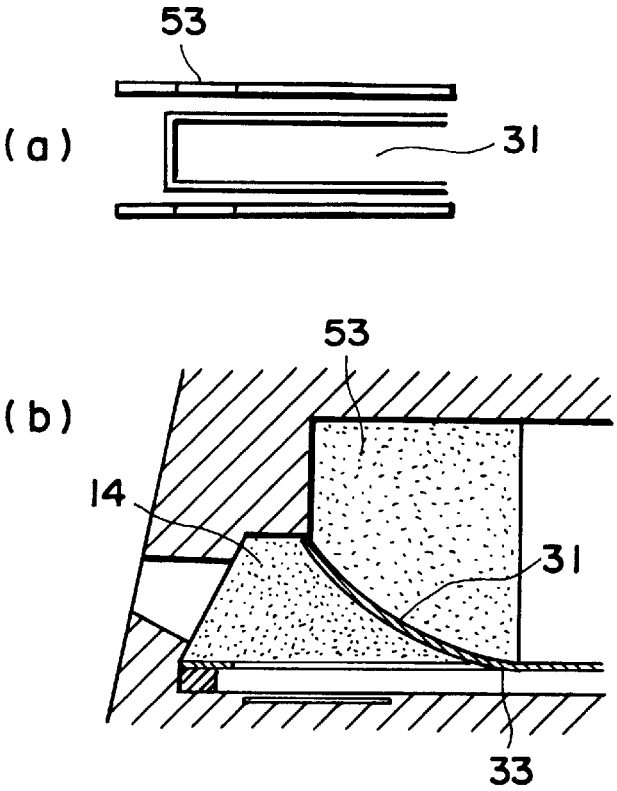
FIGS. 11(*a*) and 11(*b*) are schematic sectional views of a liquid ejecting head according to an embodiment of the present invention.

FIG. 11 depicts a liquid ejection head in which the side wall 53 of the first liquid path 14 also horizontally extends as far as the wall 53 in the preceding arrangement, except that the wall 53 in this arrangement vertically extends to the ceiling of the first liquid flow path 14 at all points. With the implementation of this structural arrangement, merely raising the ceiling of the first liquid flow path 14 is effective to reduce the repulsive force against the pivotal displacement of the movable member 31, to improve the liquid refilling efficiency, and to impede the lateral expansion of a bubble.

FIG. 12 depicts a nozzle structure in which the free end of the movable member 31 is allowed to move into the first common liquid chamber 13 as the movable member 31 is pivotally moved to the second position. The liquid refilling efficiency, and the liquid ejection efficiency, can be effectively improved by the implementation of even this nozzle structure, the only notable feature of which is that the free end of the movable member 31 is in the first liquid flow path 14 at least when the movable member is stationary.

Embodiment 2

In this embodiment, a nozzle structure in which a pivotally movable member is constituted of a portion of separation wall 30, which is formed like a tooth of a comb, at the front edge of the separation wall 30, will be described in more detail.

Figure 22:
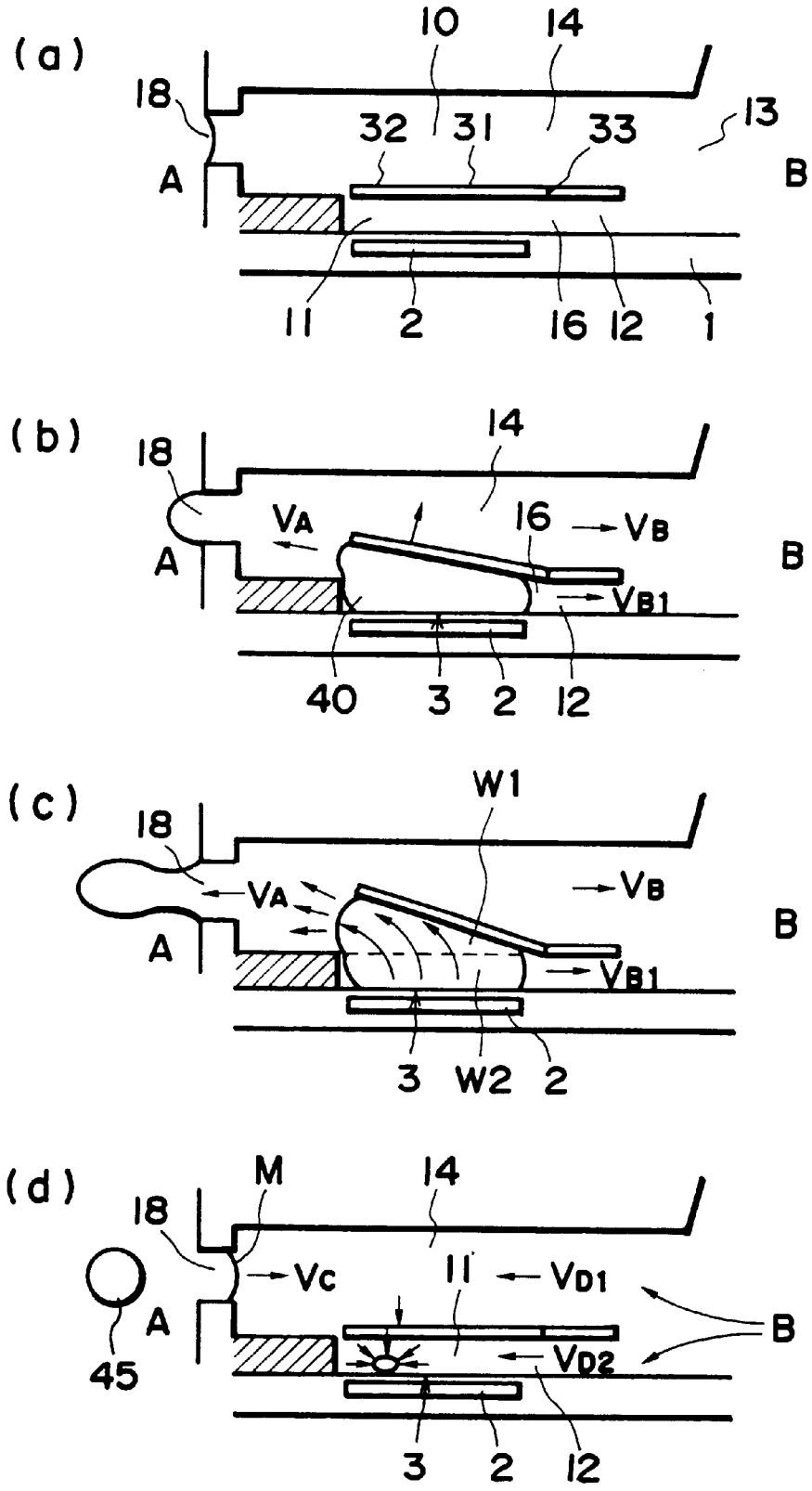
FIGS. 22(*a*)–22(*d*) are series of schematic sectional views of a liquid ejecting head according to a second embodiment of the present invention.

FIG. 22, (*a–d*), are longitudinal sectional views of the liquid ejection head in this embodiment, taken along the liquid flow path, sequentially depicting various stages of liquid ejection. FIG. 3 is a partially cutaway perspective view of the liquid ejection head illustrated in FIG. 22.

The liquid ejecting head of this embodiment comprises a heat generating element 2 (a heat generating resistor of 40 $\mu$m×105 $\mu$m in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18. It receives liquid from the common liquid chamber 13, by the amount equivalent to the amount of liquid ejected from the ejection outlet.

Above the element substrate in the liquid flow path 10, a movable member or a plate 31 in the form of a cantilever, or a tooth of a comb, of an elastic material such as metal is provided faced toward the heat generating element 2. The supporting end of the movable member is fixed to a foundation (supporting member) 34 or the like provided by patterning of photosensitive resin material on the wall of the liquid flow path 10 or the element substrate. By this structure, the movable member is supported, and a fulcrum (fulcrum portion) is constituted.

Since the movable member 31 in this embodiment is formed like a tooth of a comb, not only can it be easily and inexpensively formed, but also it can be easily aligned relative to the foundation 34.

The movable member 31 is so positioned that it has a fulcrum (fulcrum portion which is the fixed end) 33 on the upstream side with respect to the general flow of the liquid from the common liquid chamber 13 toward the ejection outlet 18 through the movable member 31 caused by the ejecting operation and that it has a free end (free end portion) 32 on the downstream side of the fulcrum 33. The movable member 31 is faced toward the heat generating element 2 with a gap of 15 $\mu$m approx. so that it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. According to the present invention, the tip of the free end portion of the movable member 31 is given a specific width, and therefore, the power from bubble generation can be more easily guided toward the ejection outlet 18. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that the movable member 31 moves or displaces to widely open toward the ejection outlet side about the fulcrum 33, as shown in FIG. 22, (*b*) and (*c*) or in FIG. 23. By the displacement of the movable member 31 or the state after the displacement, the propagation of the pressure caused by the generation of the bubble and the growth of the bubble per se are directed toward the ejection outlet. Further, since the tip of the free end portion 32 is given a specific width, the power from bubble generation can be more easily guided toward the ejection outlet 18.

Embodiment 3

Next, the third embodiment of the present invention will be described.

The liquid ejection principle in this embodiment is substantially the same as the one described in the preceding embodiments. However, in this embodiment, the liquid flow path is divided into two smaller parts, so that the liquid (bubble generation liquid) to which heat is applied to generate bubbles, and the liquid (ejection liquid) which is the primary liquid to be ejected, can be separated from each other.

Figure 24:
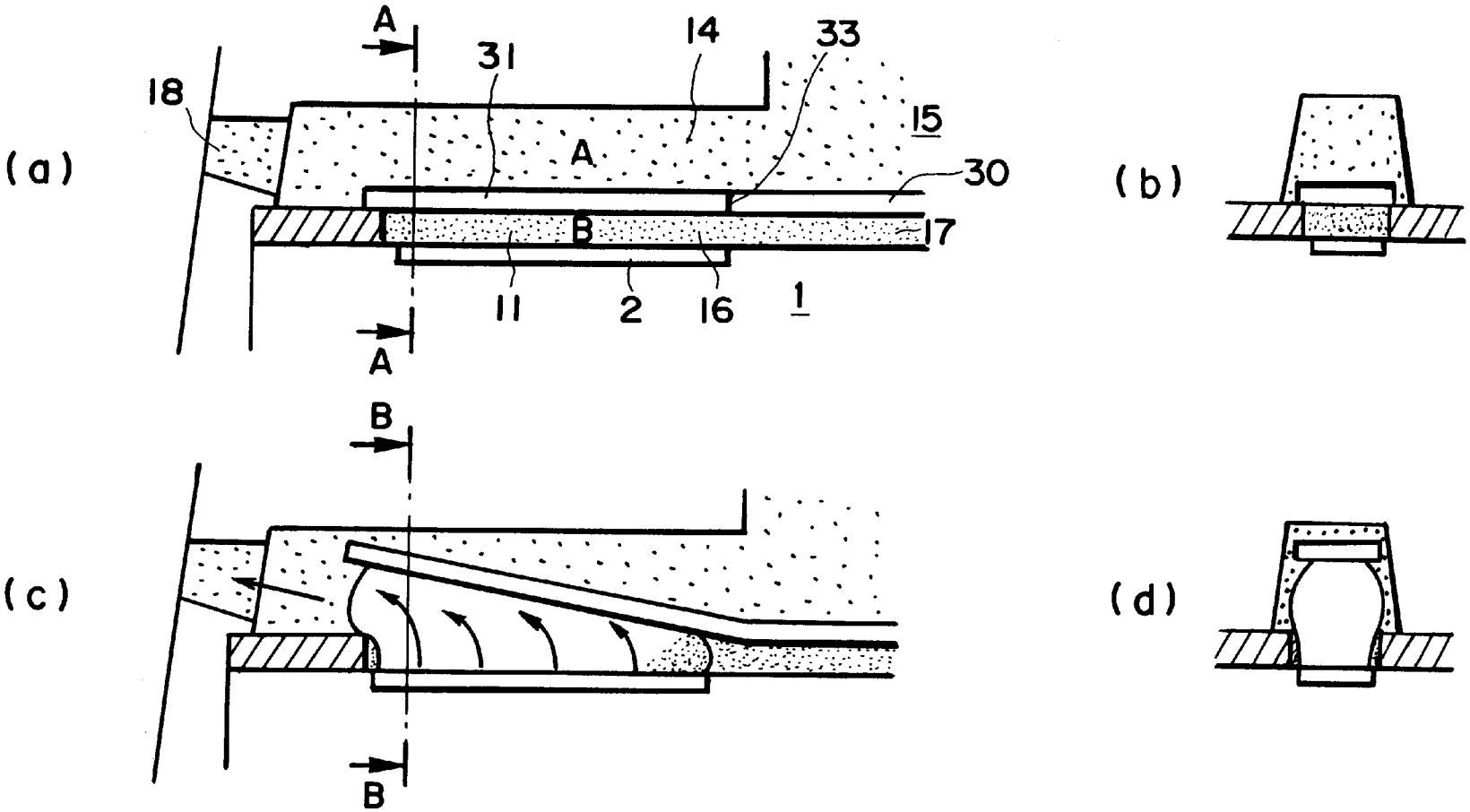
FIGS. 24(*a*)–24(*d*) is a schematic cross-sectional views of a liquid ejecting head according to Embodiment 3 of the present invention, for illustration of the operation.

FIGS. 24, (*a* and *c*) are schematic longitudinal sections of the liquid ejection head in this embodiment, FIG. 24, (*b*) being the cross section at an A—A line in (*a*), and FIG. 24, (*d*) being the cross section at a B—B line in (*c*).

In the case of the liquid ejection head in this embodiment, a second liquid flow path 16 for bubble generation is on the element substrate 1 comprising the heat generating member 2 which generates thermal energy for generating a bubble in the liquid, and on the second liquid flow path 16, a first liquid flow path 14 for the ejection liquid is disposed. The first liquid flow path directly leads to the ejection outlet 18. The upstream side of the first liquid flow path 14 is connected to the first common liquid chamber 15 which supplies a plurality of first liquid flow paths with the ejection liquid, and the upstream side of the second liquid is connected to the second common liquid chamber 17 which supplies a plurality of second liquid flow paths with the bubble generation liquid.

It should be noted here that when the bubble generation liquid and the ejection liquid are identical, a single liquid chamber may be shared by both liquid flow paths.

Between the first and second liquid flow paths, a separation wall 30 is disposed, which is formed of elastic material such as metal, and separates the common liquid chamber 15 for the first liquid flow path, from the common liquid chamber 17 for the second liquid flow path. When it is desirable that the bubble generation liquid and the ejection liquid mix with each other as little as possible, the first liquid flow path 14 and the second liquid flow path 16 should be separated as completely as possible to prevent the liquid flow between the two liquid flow paths. However, when a certain degree of mixture between the bubble generation liquid and the ejection liquid does not create a problem, it is unnecessary to give the separation wall the capability to completely separate the two liquid flow paths.

A portion of the separation wall, which is in the space directly above the top surface of the heat generating member (hereinafter, ejection pressure generating region, that is, a bubble generating region 11 constituted of A region and B region in FIG. 24), is shaped like the tooth side of a comb, each oblong piece constituting the movable member 31 whose free end is on the ejection outlet side (downstream side of the liquid flow), and whose supporting point 31 is on the common liquid chamber (15, 17) side. In other words, each movable member 31 extends like a cantilever from the supporting point 31 toward the ejection outlet. Since the bottom surface of the movable member 31 faces the bubble generating region 11(B), the movable member 31 is opened into the first liquid flow path from the ejection outlet side by the bubble generation in the bubble generation liquid. Also, since the tip of the free end portion is given a specific width, the power from bubble generation can be easily guided toward the ejection outlet. When the movable member 31 is in the state depicted in FIG. 24, (*a*), the liquid flow between the first and second liquid flow path is impeded most.

The positional relationship among the free end 32 and supporting point 33 of the movable member 31, and the heat generating member is the same as the one described in the preceding embodiment.

Also, the structural relationship between the second liquid flow path 16 and the heat generating member 2 in this embodiment is the same as the structural relationship between the liquid supply path 12 and the heat generating member 2 described in one of the preceding embodiments.

Next, the operation of the liquid ejection head in this embodiment will be described with reference to FIG. 24.

In this embodiment, the ejection liquid supplied to the first liquid flow path 14 and the bubble generation liquid supplied to the second liquid flow path 16 are water based inks, and they are identical.

As the heat generating member 2 is driven, heat is generated. This heat triggers such a film boiling phenomenon as that disclosed in U.S. Pat. No. 4,723,129, in the bubble generation liquid within the bubble generating region of the second liquid flow path, generating a bubble 40. Up to this point, the operation is the same as the one described in the preceding embodiments.

However, in this embodiment, the escape path for the pressure from bubble generation is blocked in all three directions except for the upward direction of the bubble generating region. Therefore, the pressure from bubble generation is concentrated on the movable member 31 disposed to oppose the ejection pressure generating region, pivotally displacing the movable member 31 into the first liquid flow path, starting from the position depicted in FIG. 24, (*a*) to the position depicted in FIG. 24, (*b*) as the bubble grows. This pivotal displacement of the movable member 31 creates a large path between the first and second liquid flow paths 14 and 16, allowing the pressure from bubble generation to propagate toward the ejection outlet of the first liquid flow path 14 (in the direction of an arrow mark A). Since the tip of the free end portion of the movable member 31 is given a specific width, the power from bubble generation can be more effectively guided toward the ejection outlet 18. With this pressure propagation and the aforementioned mechanical displacement of the movable member 31, the liquid is desirably ejected from the ejection outlet.

Next, as the bubble contracts, the movable member 31 returns to the position depicted in FIG. 24, (*a*). At the same time, the ejection liquid is supplied into the first liquid flow path 14 from the upstream side, by the amount matching the amount of the ejected ejection liquid. Also in this embodiment, since the ejection liquid is supplied in the direction harmonious with the closing direction of the movable member 31, the refilling of the ejection liquid is not interfered by the movable member 31.

In terms of the propagation of the pressure which occurs as the movable member 31 is pivotally displaced, the controlling of the bubble growth direction, the prevention of back wave, the operations and effects of the essential portion of the liquid ejection head in this embodiment are the same as those described in the preceding embodiments, but the liquid ejection head in this embodiment employing the structure with two liquid flow paths enjoys the following advantage in addition to those described above.

That is, according to the structure described in this embodiment, the liquid used as the ejection liquid can be different from the liquid used as the bubble generation liquid. In other words, the ejection liquid can be ejected by the pressure from a bubble generated in the bubble generation liquid different from the ejection liquid. Therefore, high viscosity liquid such as polyethylene glycol, which has been difficult to eject due to the fact that in high viscosity liquid, application of heat does not trigger bubble generation intense enough to generate pressure sufficient for liquid ejection, can be desirably ejected by filling the high viscosity liquid in the first liquid flow path, and filling the second liquid flow path with the bubble generation liquid, for example, liquid in which bubbles can be desirably generated or liquid with a low boiling point, more specifically, mixture of ethanol and water (ethanol:water=4:6; viscosity: 1–2 cP).

Further, choosing as the bubble generation liquid such liquid that does not leave baked deposit or the like on the surface of the heat generating member even when subjected to heat stabilizes bubble generation, making it possible to accomplish desirable ejection.

Further, the liquid ejection head in this embodiment which employs the head structure in accordance with the present invention enjoys not only the advantage described in this embodiment, but also the advantages described in the preceding embodiments, and therefore, can eject the high viscosity liquid or the like with additional ejection efficiency and ejection force.

Further, liquid that is inferior in heat resistance can be ejected with high ejection efficiency and high ejection force, as described above, without thermally damaging the liquid, simply by filling the first liquid flow path with such liquid, and the second liquid flow path with such liquid that is not likely to be thermally denatured, and is capable of desirably generating bubbles. <Positional relation between second liquid flow path and movable member>

Figure 14:
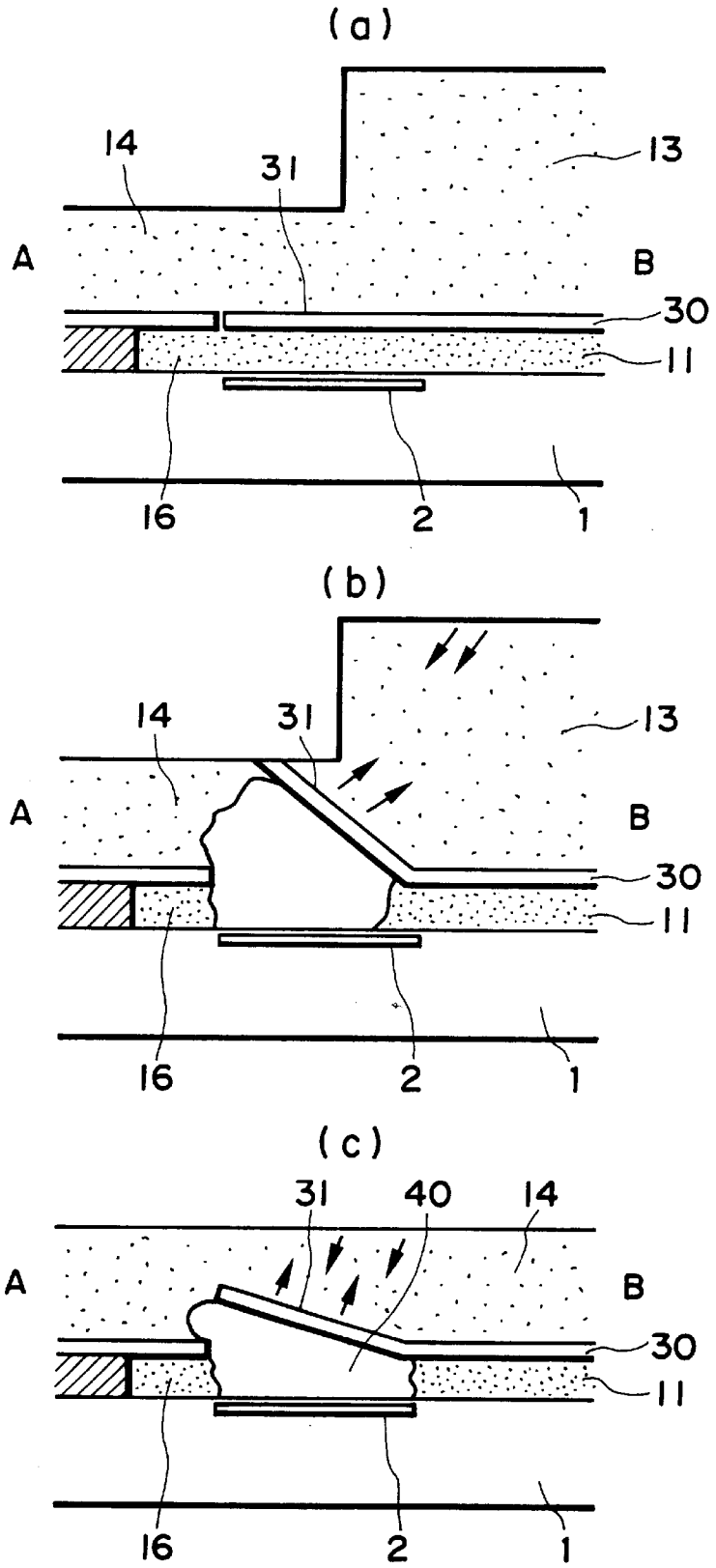
FIGS. 14(*a*)–14(*c*) illustrate an operation of a movable member.
Figure 15:
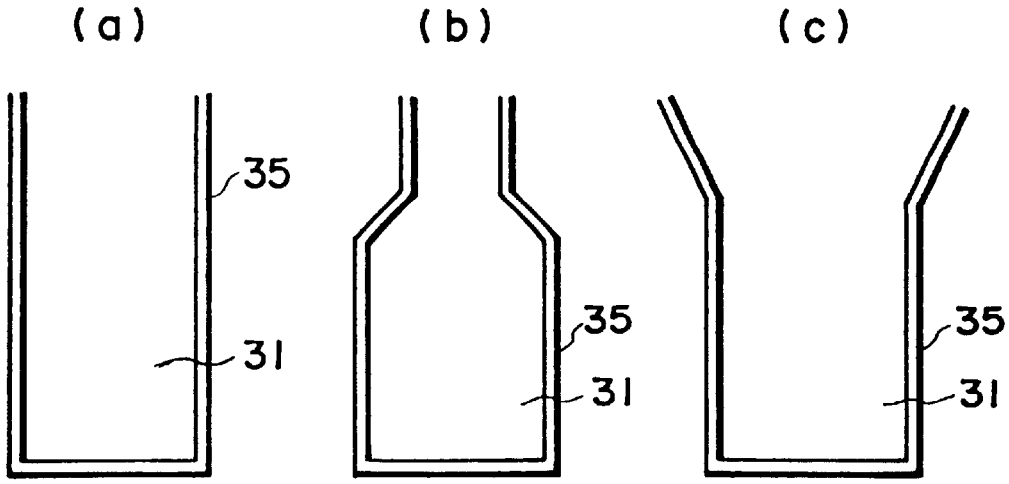
FIG. 15(*a*)–15(*c*) illustrate another configuration of a movable member.
Figure 16:
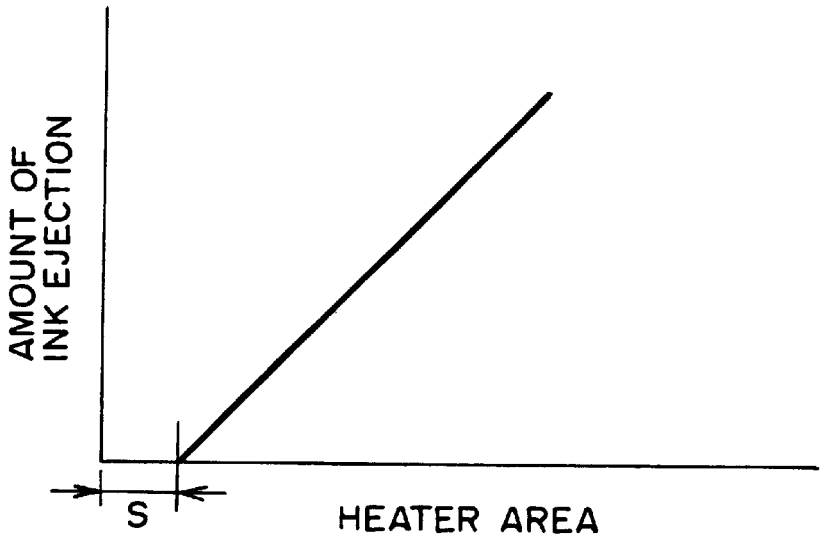
FIG. 16 shows a relation between an area of a heat generating element and an ink ejection amount.
Figure 25:
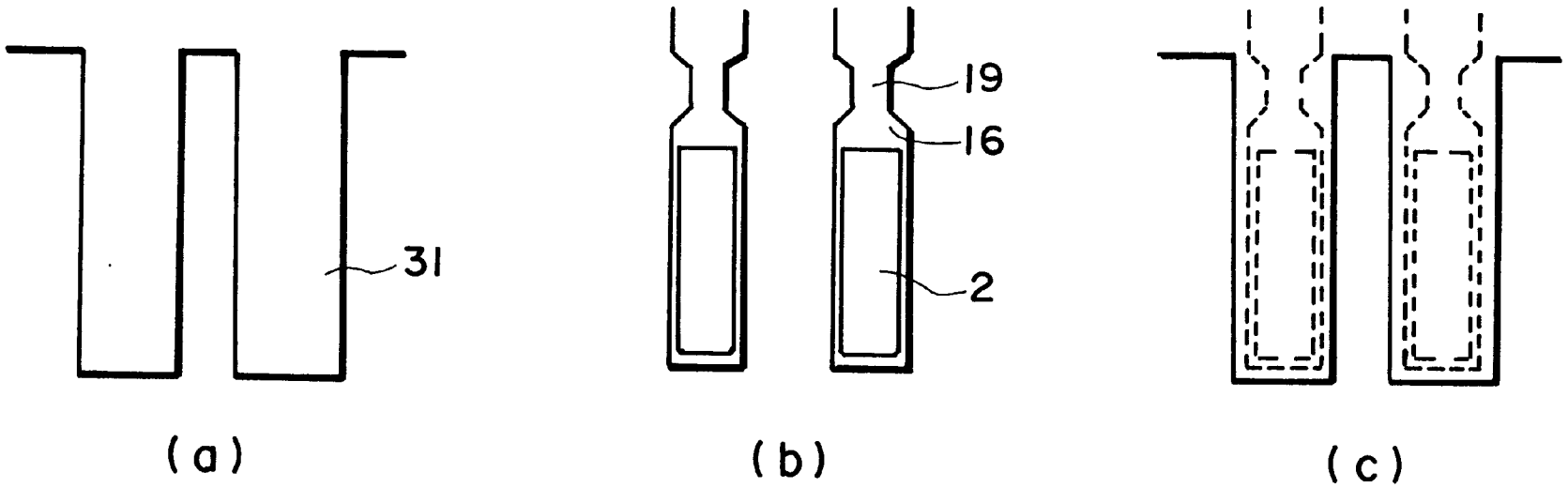
FIGS. 25(*a*)–25(*c*) illustrate a positional relation between movable member and the second liquid flow path of a liquid ejecting head according to an embodiment of the present invention.

FIG. 25 is an illustration of the positional relation between the above-described movable member 31 and second liquid flow path 16, and (*a*) is a view of the movable member 31 position of the partition wall 30 as seen from the above, and (*b*) is a view of the second liquid flow path 16 as seen from the above without partition wall 30. FIG. 14, (*c*) is a schematic view of the positional relation between the movable member 31 and the second liquid flow path 16 wherein the elements are overlaid. In these drawings, the bottom is a front side having the ejection outlets.

The second liquid flow path 16 of this embodiment has a throat portion 19 on the upstream side of the heat generating element 2 with respect to the general flow of the liquid from the second common liquid chamber side to the ejection outlet through the heat generating element position, and the movable member position along the first flow path, so as to provide a chamber (bubble generation chamber) effective to suppress easy escape, toward the upstream side, of the pressure produced upon the bubble generation in the second liquid flow path 16.

In the case of the conventional head wherein the flow path where the bubble generation occurs and the flow path from which the liquid is ejected, are the same, a throat portion may be provided to prevent the escape of the pressure generated by the heat generating element toward the liquid chamber. In such a case, the cross-sectional area of the throat portion should not be too small in consideration of the sufficient refilling of the liquid.

However, in the case of this embodiment, much or most of the ejected liquid is from the first liquid flow path, and the bubble generation liquid in the second liquid flow path having the heat generating element is not consumed much, so that the filling amount of the bubble generation liquid to the bubble generation region 11 may be small. Therefore, the clearance at the throat portion 19 can be made very small, for example, as small as several $\mu$m—ten and several $\mu$m, so that the escape of the pressure produced in the second liquid flow path can be further suppressed to further concentrate it to the movable member side. The pressure can be used as the ejection pressure through the movable member 31, and therefore, high ejection energy use efficiency and high ejection pressure can be accomplished. The configuration of the second liquid flow path 16 is not limited to the one described above, but may be any if the pressure produced by the bubble generation is effectively transmitted to the movable member side.

As shown in FIG. 25, (*c*), the lateral sides of the movable member 31 cover respective parts of the walls constituting a part of the second liquid flow path so that the falling of the movable member 31 into the second liquid flow path is prevented. By doing so, the above-described separation between the ejection liquid and the bubble generation liquid is further assured. Furthermore, the escape of the bubble through the slit can be suppressed so that ejection pressure and ejection efficiency are further increased. Moreover, the above-described effect of the refilling from the upstream side by the pressure upon the collapse of the bubble, can be further enhanced.

In FIG. 24, (*b*), with the pivotal displacement of the movable member 6 into the first liquid flow path 14, a part of the bubble generated in the bubble generation region of the second liquid flow path 4 extends into the first liquid flow path 14 side. By giving the second flow path a height that permits such extension of the bubble, the ejection force is further improved as compared with the case without such extension of the bubble. To provide such extending of the bubble into the first liquid flow path 14, the height of the second liquid flow path 16 is preferably lower than the height of the largest bubble, more particularly, the height is preferably several $\mu$m–30 $\mu$m, for example. In this example, the height is 15 $\mu$m.

<Movable Member and Partition Wall>

Figure 26:
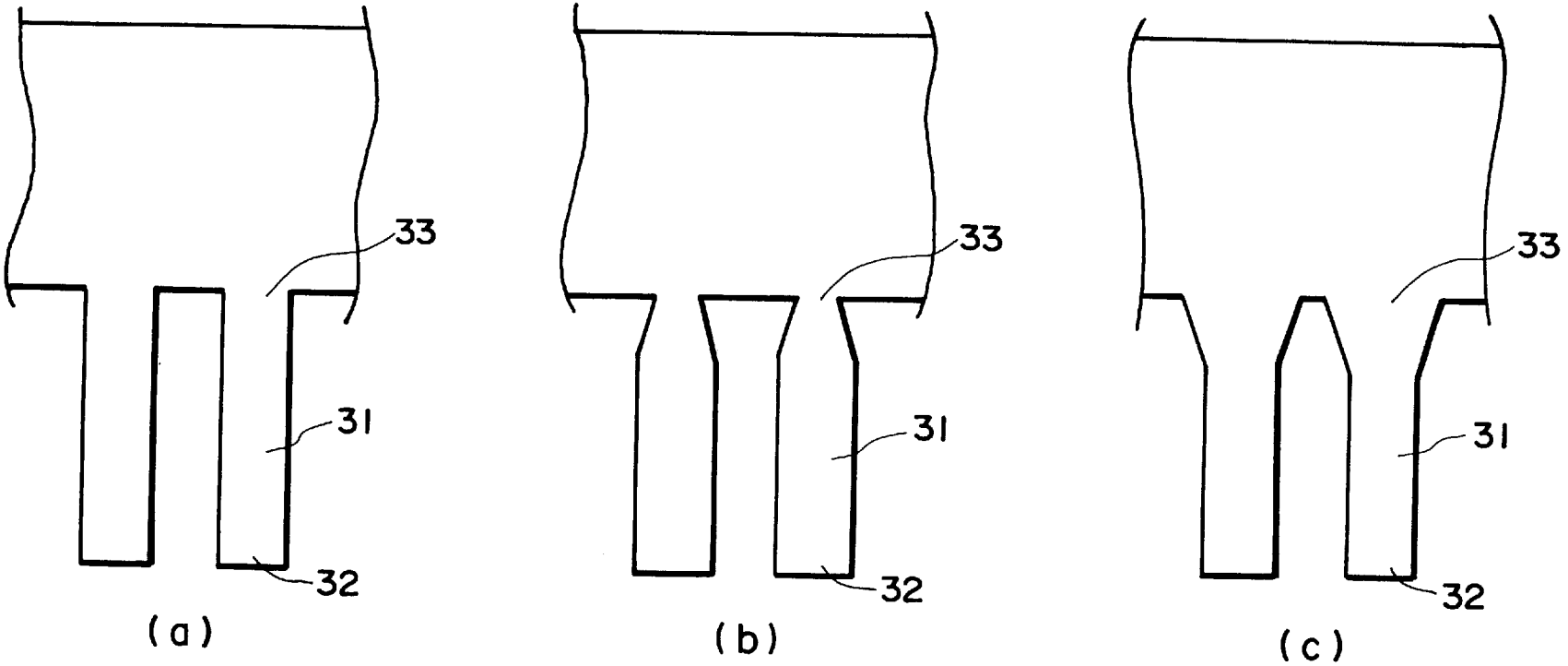
FIG. 26 is shows another configuration of a movable member of a liquid ejecting head according to an embodiment of the present invention.

FIG. 26 shows another example of the movable member 31, wherein reference numeral 35 designates a slit formed in the partition wall, and the slit is effective to provide the movable member 31. The fulcrum 33 side of the movable member is a common member, and the front free end 32 side is open (comb-like), so that first liquid flow paths and second liquid flow paths can be provided only by the top plate with the advantage of large tolerance in the positioning precision in the direction of the liquid flow.

In the foregoing embodiment, the comb-like movable member 31 and the separation wall 30 having the movable member is of nickel having a thickness of 5 μm, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nytril group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as poly—sulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, polysulfone, liquid crystal polymer (LCP), or chemical compound thereof, or metal such as silicon diode, silicon nitride, nickel, gold, stainless steel, alloy thereof, chemical compound thereof, or materials coated with titanium or gold.

The thickness of the separation wall is determined depending on the used material and configuration from the standpoint of sufficient strength as the wall and sufficient operativity as the movable member, and generally, 0.5 μm–10 μm approx. is desirable.

When the separated bubble generation liquid and ejection liquid are used as has been described hereinbefore, the movable member functions in effect as the separation member. When the movable member moves in accordance with generation of the bubble, a small amount of the bubble generation liquid may be mixed into the ejection liquid. Usually, the ejection liquid for forming an image in the case of the ink jet recording, contains 3% to 5% approx. of the coloring material, and therefore, if content of the leaked bubble generation liquid in the ejection liquid is not more than 20%, no significant density change results. Therefore, the present invention covers the case where the mixture ratio of the bubble generation liquid of not more than 20%.

In the foregoing embodiment, the mixing of the bubble generation liquid is at most 15%, even if the viscosity thereof is changed, and in the case of the bubble generation liquid having the viscosity not more than 5 cP, the mixing ratio was at most 10% approx., although it is different depending on the driving frequency.

The ratio of the mixed liquid can be reduced by reducing the viscosity of the ejection liquid in the range below 20 cps (for example not more than 5%

<Manufacturing of the Liquid Ejection Head>

The description will be made as to a manufacturing step of the liquid ejecting head according to an embodiment of the present invention.

Figure 23:
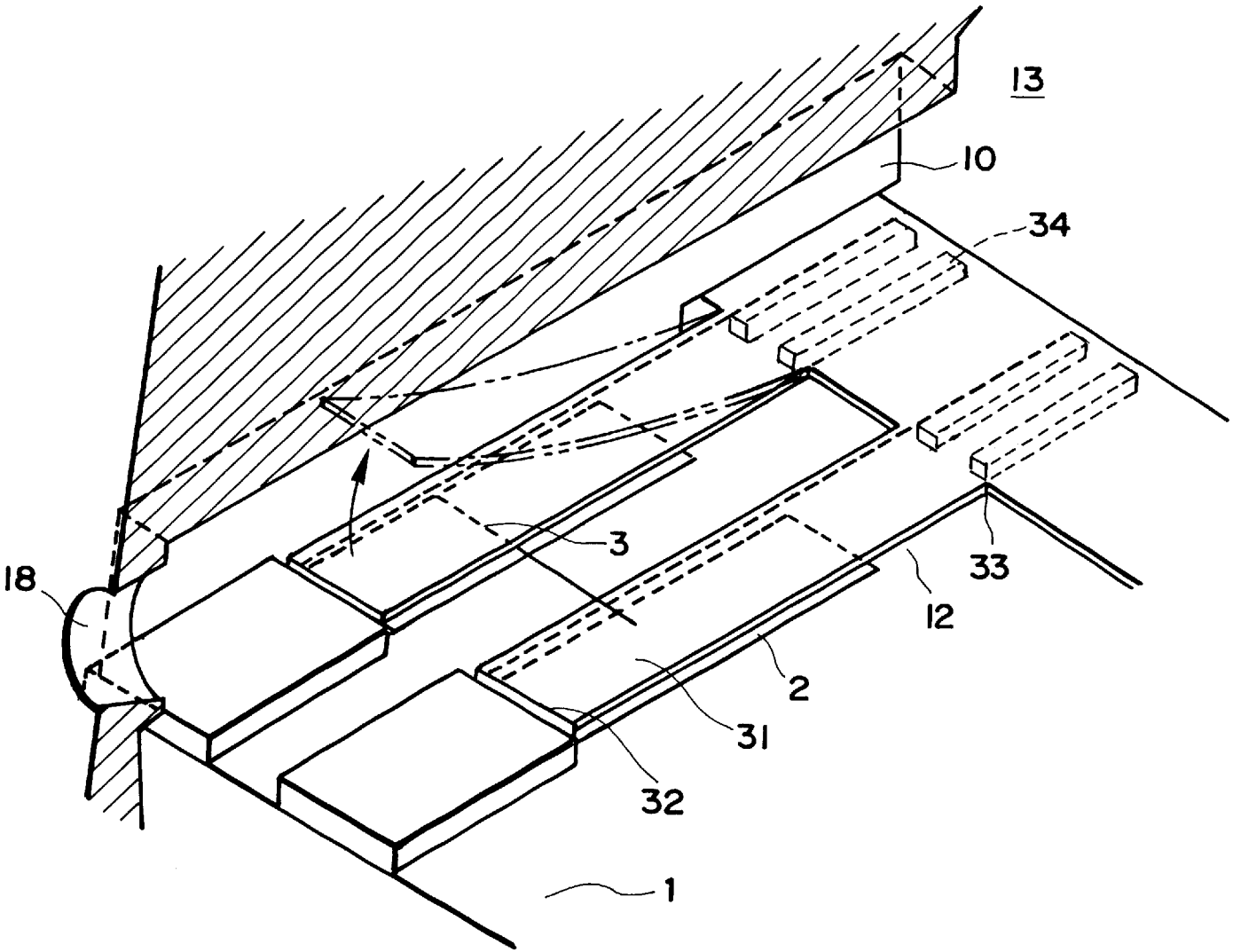
FIG. 23 is partly broken perspective view of a liquid ejecting head of FIG. 22.

In the case of the liquid ejecting head as shown in FIG. 23, the foundation 34 for forming the movable member 31 on the element substrate 1 is provided by patterning a DRY FILM or the like, and a movable member 31 is bonded or welded on the foundation 34. Thereafter, the grooved member having a plurality of grooves constituting the liquid flow paths 10, the ejection outlets 18 and a recess constituting the common liquid chamber 13, is connected to the element substrate 1 so that grooves and the movable members are aligned.

Since the movable member is comb-like form wherein the fulcrum side is integral, and the free end side is open, so that first liquid flow paths and the second liquid flow paths are provided only by the top plate, thus avoiding the complicated structure of the two passage structure.

Figure 27:
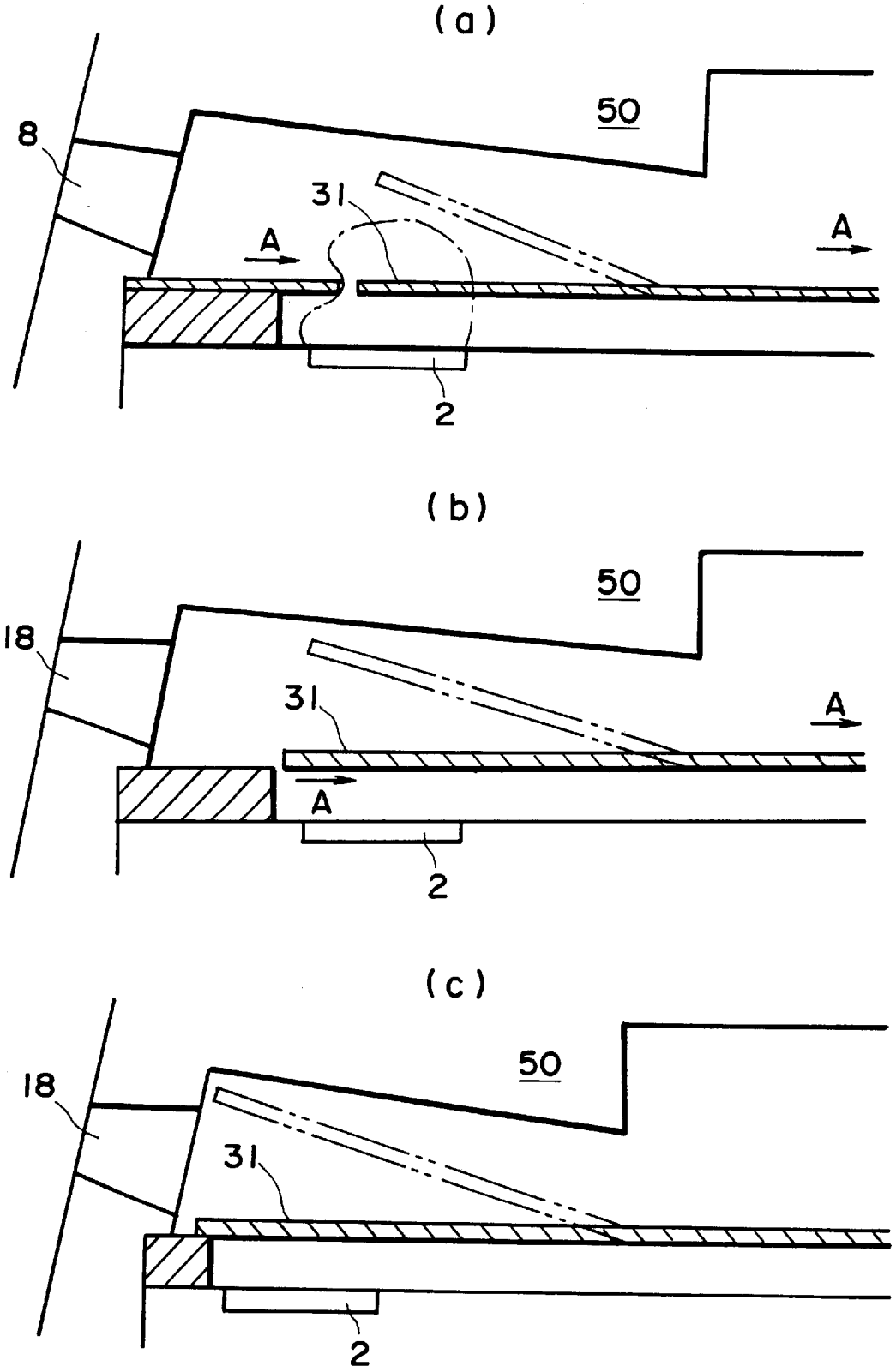
FIGS. 27(*a*)–27(*c*) are illustrations of a feature during manufacturing of the movable member, according to an embodiment of the present invention.

In addition, since the movable member is comb-like, the tolerance in the accuracy of the positioning is eased in the liquid flow path direction. The comb-like form may be provided by forming slits by laser machining or cutting in a plate. In such a case, as shown in FIG. 27(*a*), if the positioning accuracy is not high enough, excess portion at the front free end portion of the movable member may be faced to the bubble generating region with the result of lowering of the ejection efficiency. However, according to the present invention, the free end of the movable member is open, so that ejection efficiency is high even if the positioning accuracy is relatively poor in the direction of the liquid flow path, as shown in FIG. 27(*b*). Additionally, since the excess front end portion (ejection outlet side) is not required, the free end can be easily made closer to the ejection outlet side as shown in FIG. 27(*c*), so that latitude in the design with respect to the nozzle length is enhanced.

FIGS. 28–35 are schematic drawings of the liquid ejection heads in the fourth to seventh embodiments, which are produced using the method in accordance with the present invention.

Figure 28:
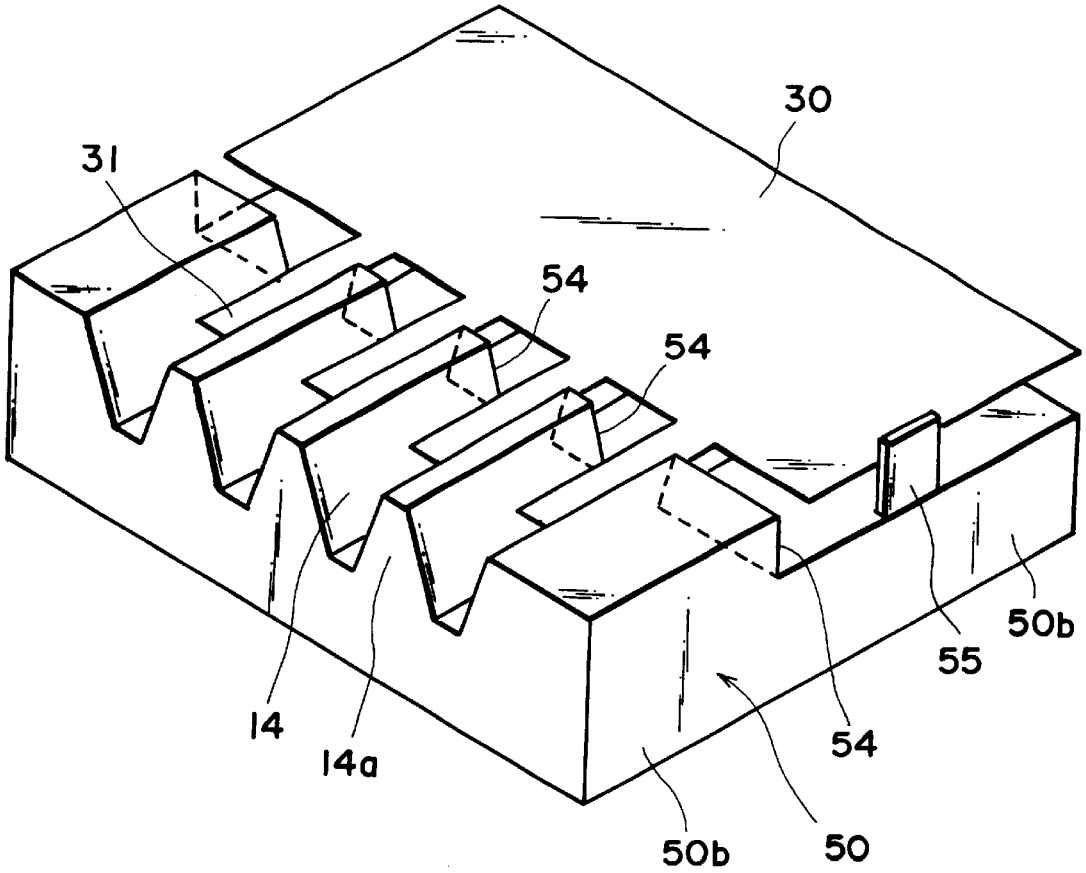
FIG. 28 is perspective view illustrating a manufacturing method of a liquid ejecting head, according to Embodiment 4 of the present invention.
Figure 29:
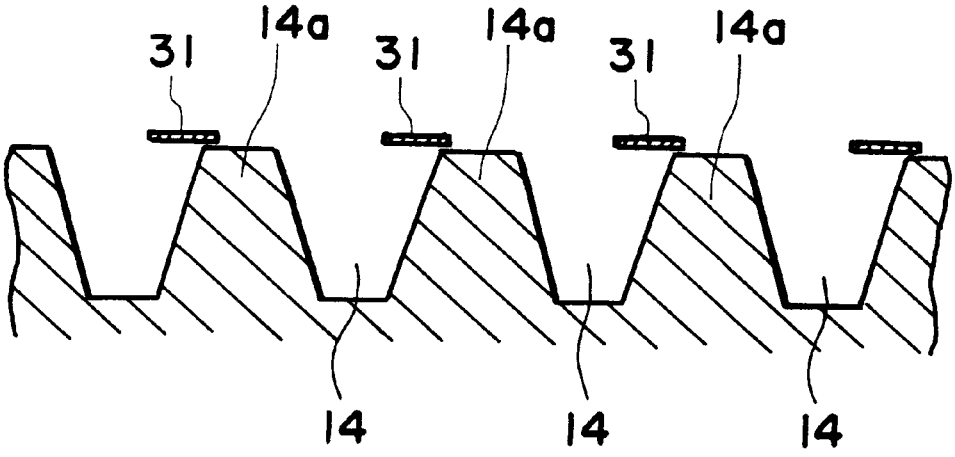
FIGS. 29(*a*)and 29(*b*) are schematic views showing a movable member and a grooved member according to Embodiment 5.
Figure 29:
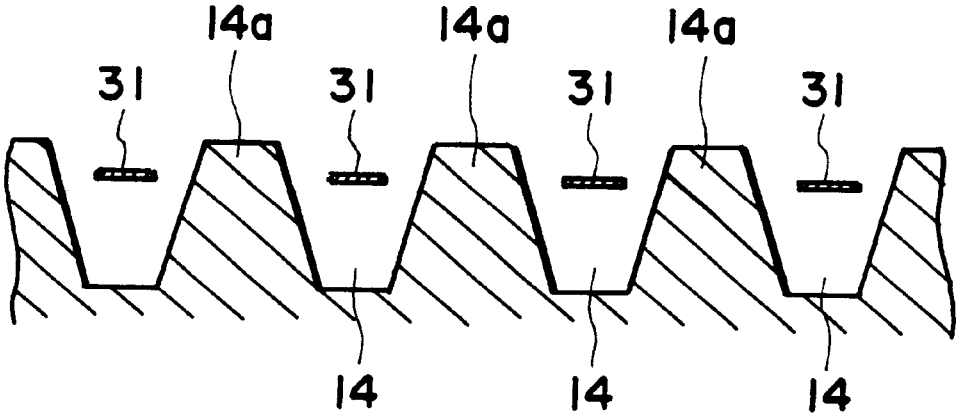

FIG. 28 is a schematic perspective view of the liquid ejection head in the fourth embodiment of the present invention, depicting a separation wall inclusive of a plurality of pivotally movable members, and a grooved member with a plurality of grooves which are to become liquid flow paths, each of which is correspondent to one of the plurality of pivotally movable members.

In FIG. 28, a reference numeral 50 designates a grooved member (top plate) with a plurality of grooves (recessed portions) which are to become a plurality of liquid flow paths, each leading to its own ejection outlet, and a reference numeral 30 designates a separation wall, one edge of which forms a plurality of pivotally movable members 31, rendering the separation wall resemblant to a comb. The grooved member 50 is constituted of two portions: a thick portion 50*a* on the downstream side and a thin portion 50*b* on the upstream side. The vertical surface of the upstream end, relative to the liquid flow direction, of the thick portion 50*a*, that is, the vertical plane which divides the thick downstream portion 50*a* and the thin upstream portion 50*b* serves as a contact type positioning reference 54, with which the separation wall 30 is placed in contact to be aligned with the top plate 50 in the direction indicated by an arrow mark Y. The plurality of grooves for forming the plurality of liquid flow paths 14 extend substantially in parallel in the direction perpendicular to the contact type frontal positioning reference 54. The cross section of each liquid flow path 14 is in the form of an inverted isosceles trapezoid, narrowing toward the bottom, and is separated from the adjacent ones by the liquid flow path walls 14*a* whose cross section is in the form of an isosceles trapezoid. Further, the grooved member 50 is provided with a contact type lateral positioning reference 55, with which the separation wall 30 is placed in contact to be aligned with the grooved member 50 in the direction indicated by an arrow mark X. The contact type lateral positioning reference 55 is perpendicularly erected from the top surface of the thin rear portion 50*b* of the grooved member 50, at the lateral edge.

The downstream side of the separation wall 30 forms the plurality of the pivotally movable members 31, resembling the tooth side of a comb, and as the separation wall 30 is aligned with the groove member 50, each of the plurality of pivotally movable member 31 opposes the corresponding liquid flow path 14.

The liquid ejection head in accordance with the present invention is manufactured by combining the grooved member 50 and separation wall 30, which are structured as described above, in the following manner. First, the separation wall 30 must be aligned with the grooved member 50. This is accomplished by vibrating the grooved member 50 with the use of a vibrating means such as a vibrator after placing the separation wall 30 on the grooved member 50 in such a manner that each of the movable members 30 is disposed in the corresponding liquid flow path 14 (groove) or on the liquid flow path wall 14*a* adjacent to the corresponding liquid flow paths 14 (grooves). More specifically, first, the grooved member 50 is vibrated to cause the movable members 31 of the separation wall 30 to settle down into the corresponding liquid flow paths 14 (grooves) of the grooved member 50. Next, the grooved member 50 is tilted so that the upstream side, relative to the liquid flow direction, of the liquid flow path wall 14*a* is raised, and then, the grooved member 50 is vibrated again to place the separation wall 30 in contact with the contact type frontal positioning reference 54 and the contact type lateral positioning reference 55. Thus, the separation wall 30 and the grooved member 50 are accurately positioned, or fitted, relative to each other. At this point, the separation wall 30 may be fixed to the grooved member 50. Fixing the two components together renders the following assembly steps easier.

According to this embodiment, each of the movable members 31 is fitted in the corresponding groove which is to become the liquid flow path 14, and therefore, there is little possibility that the movable members 13 are damaged while the grooved member 50 is aligned with the element substrate.

Figure 30:
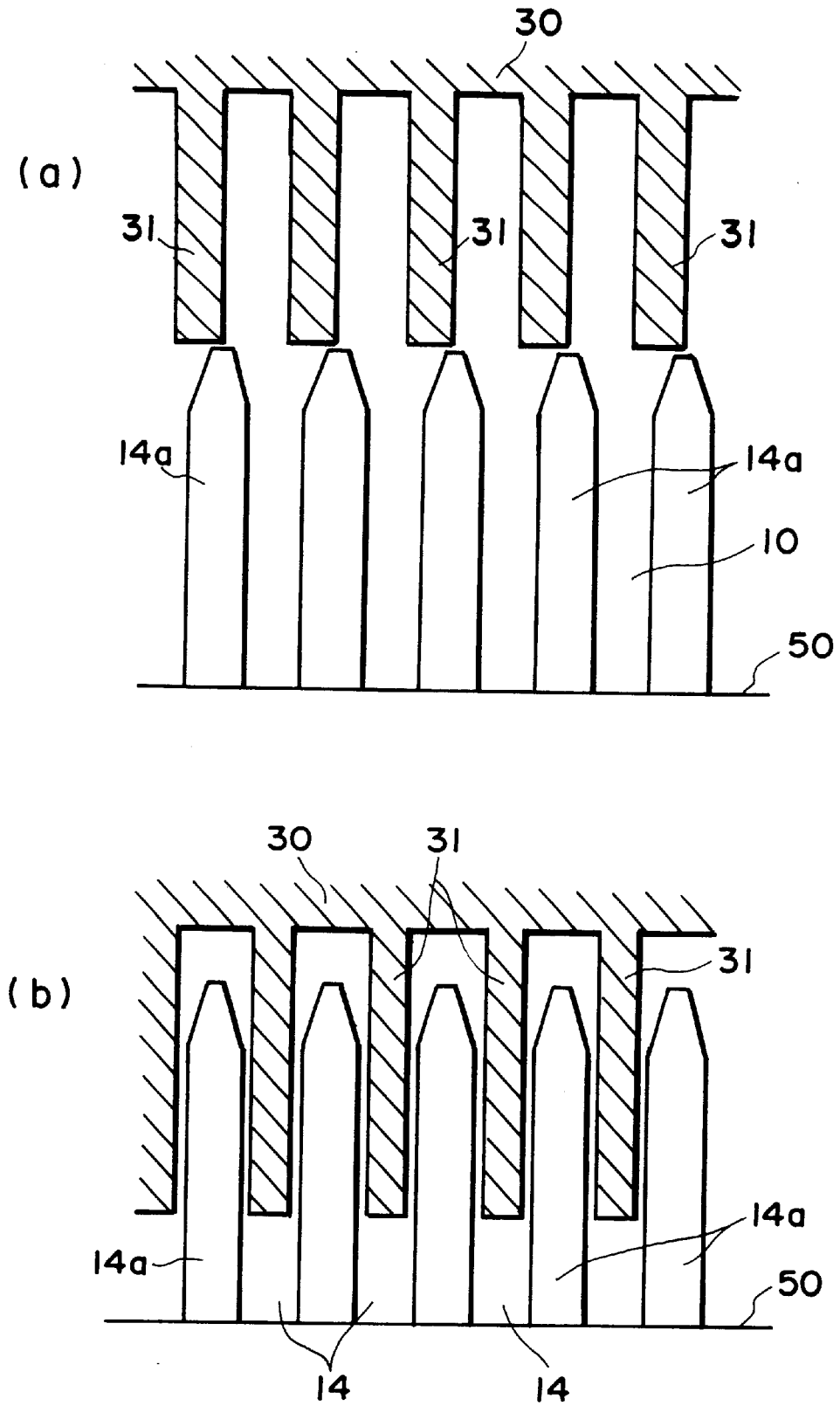
FIGS. 30(*a*)and 30(*b*) are schematic views showing a manufacturing method of a liquid ejecting head according to Embodiment 5 of the present invention.

FIG. 30 is a schematic drawing which depicts another method for manufacturing the liquid ejection head in accordance with the present invention.

In the preceding manufacturing method, the grooved member 50 was vibrated to let the separation wall 30 be properly positioned relative to the grooved member 50. However, in this embodiment, another method is described, according to which the separation wall 30 is lifted by compressed air so that the separation wall 30 settles down on the grooved member 50 in alignment with the grooved member 50 by its own weight.

More specifically, the separation wall 30 is first placed on the grooved member 50 in such a manner that each of the movable members 31 of the separation wall 30 is disposed on the liquid flow path wall 14*a* adjacent to the corresponding liquid flow path 14 (groove), and then, the grooved member 50 is tilted so that the upstream side, relative to the liquid flow direction, of the liquid flow path wall 14*a* is raised, as described in the preceding embodiment. Next, the separation wall 30 is caused to hover with the use of compressed air, allowing the separation wall 30 to be accurately positioned by its own weight, in alignment with the grooved member 50, with the movable members 31 of the separation wall 30 being fitted in the corresponding grooves of the grooved member 50, which are to become the liquid flow paths 14.

Figure 31:
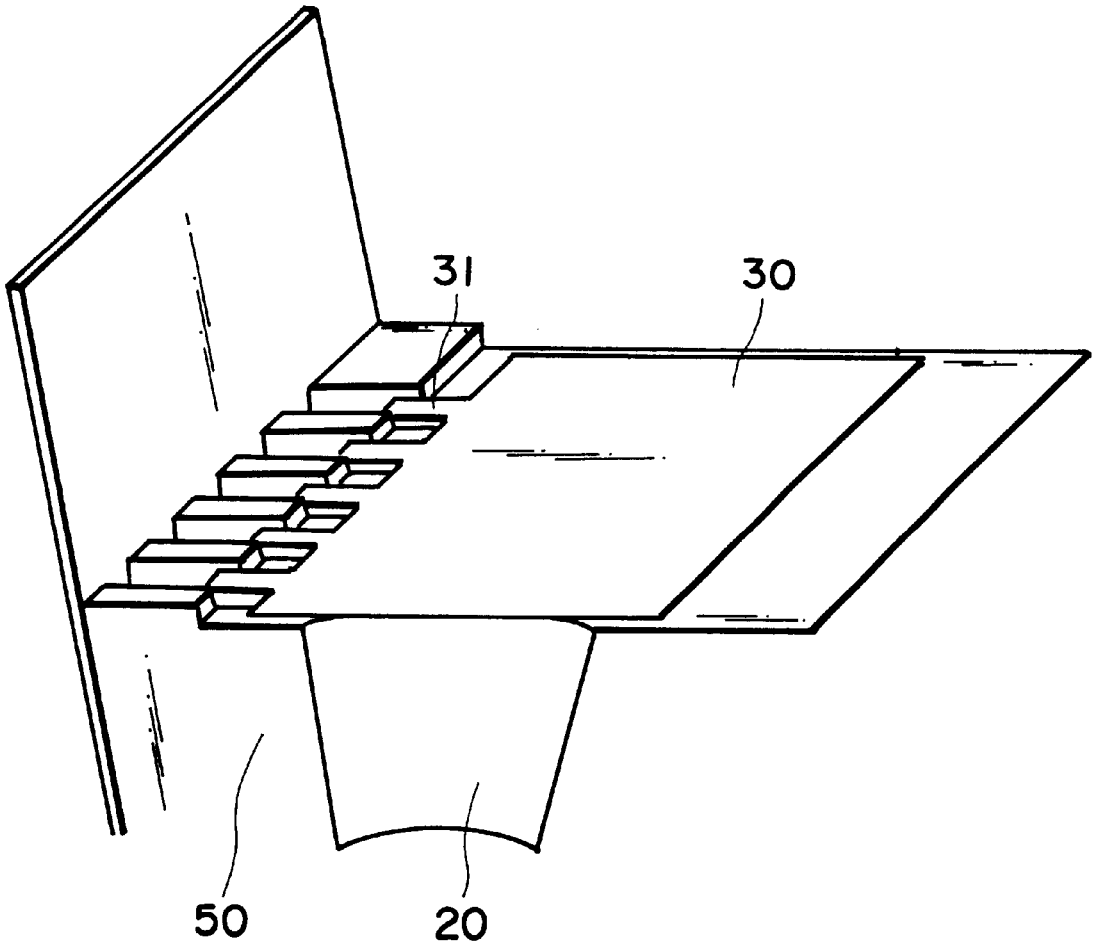
FIG. 31 is schematic view showing a modified example of Embodiment 5.

FIG. 31 is a schematic perspective drawing which depicts the fifth embodiment of the present invention, in which compressed air is sent in through the liquid supply port 20 of the grooved member 50.

By sending compressed air through the liquid supply port 20 as described above, the separation wall 30 can be made to hover in a desirable member, and therefore, the separation 30 and the grooved member 50 can be accurately positioned relative to each other with ease.

Figure 32:
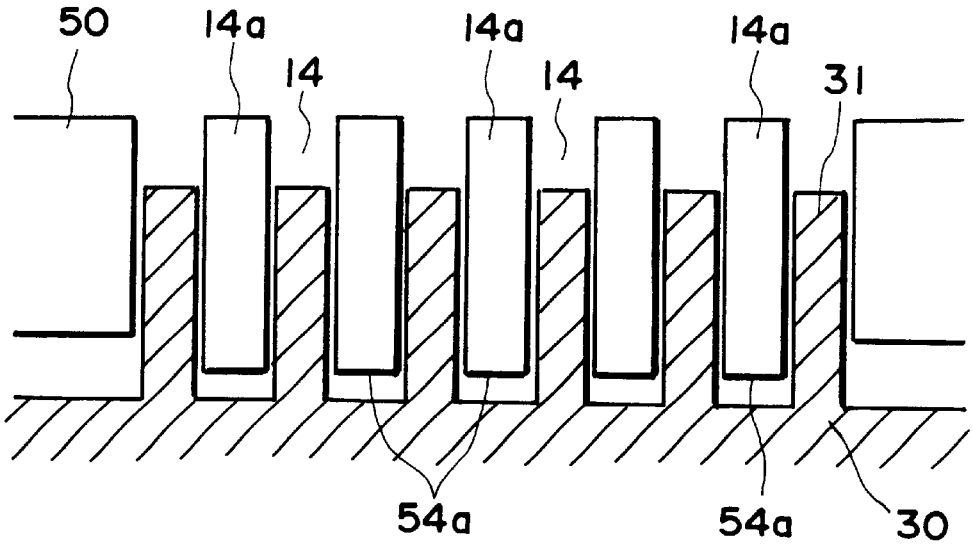
FIG. 32 is schematic view showing a modified example of Embodiment 5.
Figure 33:
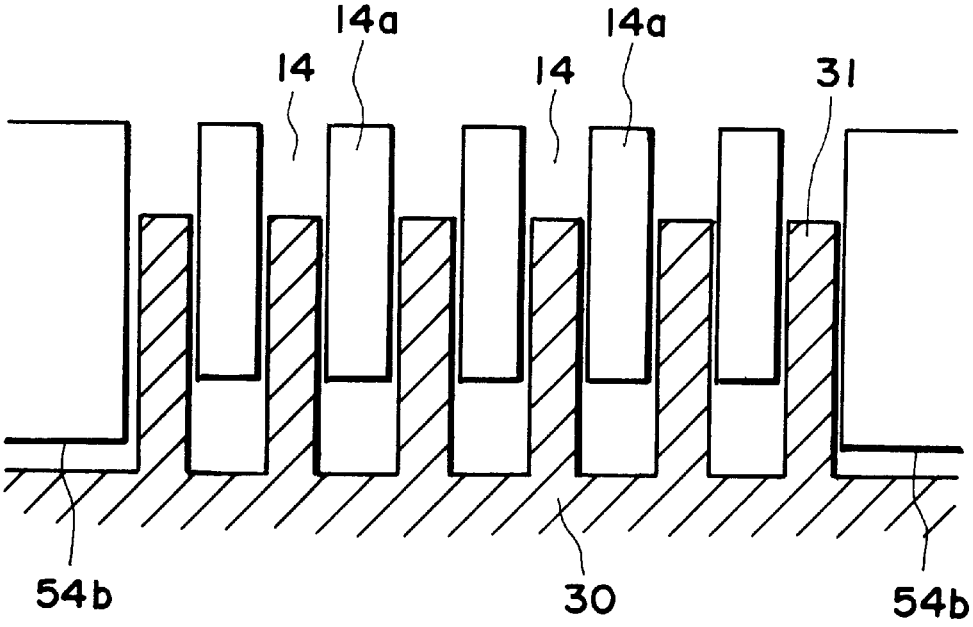
FIG. 33 is a schematic view showing another embodiment of the reference portion of the grooved member.

FIGS. 32 and 33 illustrate the contact type frontal positioning references 54*a* and 54*b*, respectively, with which the grooved member 50 is provided. FIG. 32 depicts an arrangement in which the grooved member 50 is shaved off at two portions, which constitute the laterally outward wall portion of the laterally outermost liquid flow path, so that only the rearward facing vertical surface 54*a* of the liquid flow path wall 14*a* is allowed to serve as the contact type frontal positioning reference, whereas FIG. 33 depicts another arrangement in which only the rearward facing vertical surface 54*b* of the laterally outward wall portion of the laterally outermost liquid flow path is allowed to serve as the contact type frontal positioning reference. In either case, the separation wall 30 and the grooved member 50 can be properly positioned relative each other with ease. However, the structure illustrated in FIG. 33 allows the liquid to be supplied through the relatively larger gap formed between the separation wall 30 and the rearward facing surface of the liquid flow path wall 14*a*, improving thereby the refilling speed for the liquid ejection head.

Figure 34:
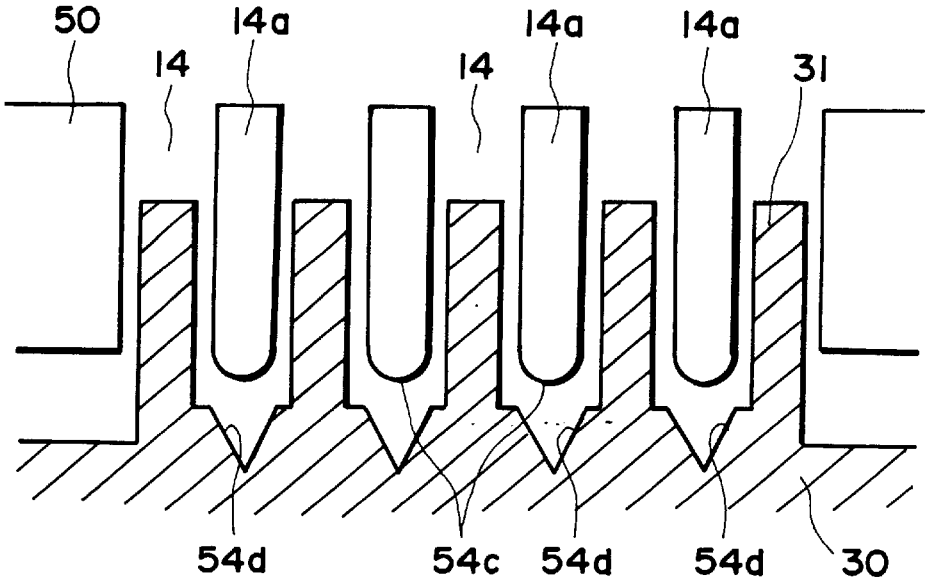
FIG. 34 is a schematic view showing a manufacturing method of a liquid ejecting head according to Embodiment 5 of the present invention.

FIG. 34 is a schematic drawing which depicts the manufacturing method for the liquid ejection head in the sixth embodiment of the present invention.

Also in this embodiment, the upstream side portion 54*c* of the liquid flow path wall 14*a* of the grooved member 50 is used as the contact type frontal positioning reference. However, in this embodiment, the upstream side portion 54*c* is modified to give it a semicircular horizontal section, and the contact portion 54*d*, that is, the portion at the base of the movable member 31 comparable to a tooth of a comb, which is placed in contact with the contact type frontal positioning reference 54*c*, is modified to give it a V-shaped horizontal section, so that the separation wall 30 and the grooved member 50 can be aligned in two directions through a single step. More specifically, as illustrated, the separation wall 30 is first placed on the grooved member 50 in such a manner that the movable member 31 of the separation wall 30, resembling a comb tooth, is fitted within the groove of the grooved member 50, which is to become the liquid flow path 14. Then, the V-shaped contact type frontal positioning reference 54*d* of the separation wall 30, located between the adjacent movable members 31 of the separation wall 30, is placed in contact with the contact type frontal positioning reference portion 54*c* of the liquid flow path wall 14*a* of the grooved member 50, having a semicircular horizontal section. As a result, the separation wall 30 and the grooved member 50 are desirably positioned relative to each other. In this positioning, the contact type positioning reference portion 54*c* of the liquid flow path wall 14*a* of the grooved member 50 has a semicircular horizontal section, whereas the contact type positioning reference portion 54*d* of the separation wall 30, located between the adjacent two movable members 31 of the separation wall 30, has a V-shaped horizontal section, and therefore, as both are placed in contact with each other, the separation wall 30 and the grooved member 50 are accurately aligned in two directions, that is, the lateral direction and the frontward-backward direction, through a single step.

Figure 35:
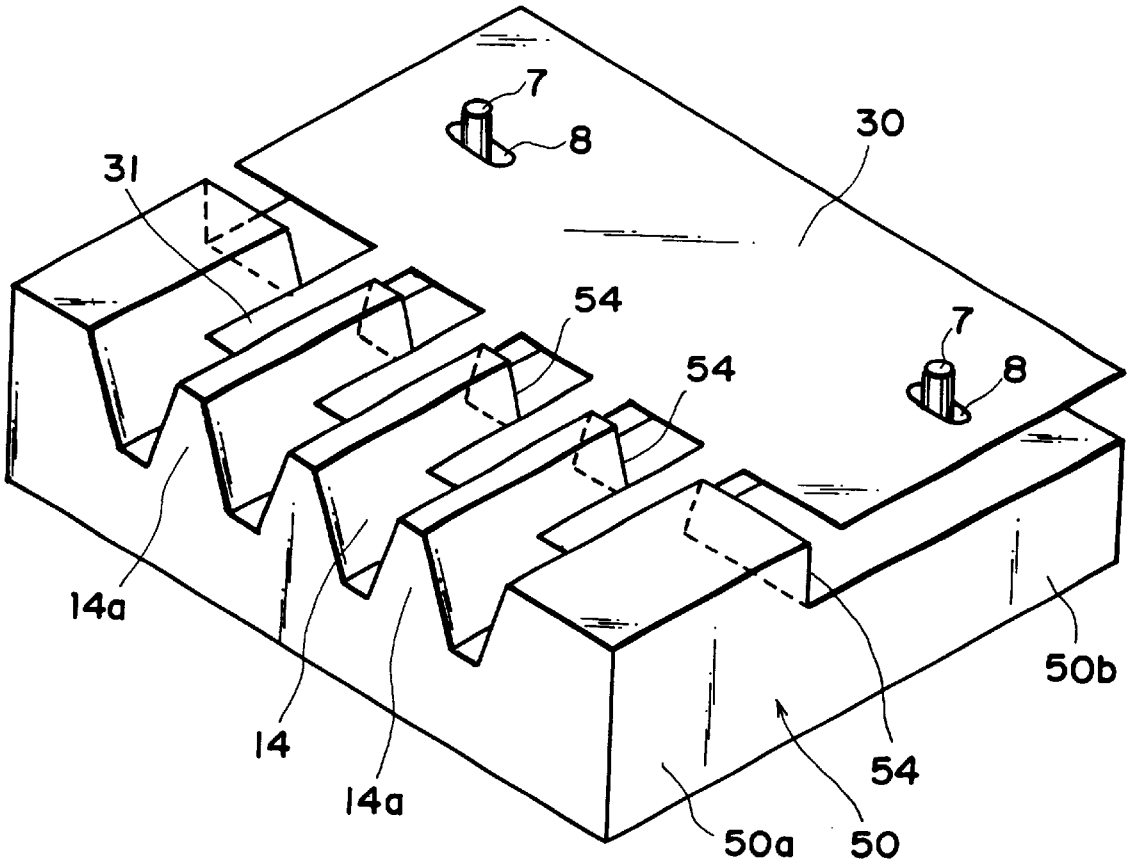
FIG. 35 is perspective view illustrating a manufacturing method of a liquid ejecting head, according to Embodiment 7 of the present invention.

FIG. 35 is a schematic perspective drawing which depicts the manufacturing method for the liquid ejection head in the seventh embodiment of the present invention.

In this embodiment, the grooved member 50 is provided with a pair of contact type referential pins 7, and the separation wall 30 is provided with a pair of contact type elongated referential windows 8 which correspond to the referential pin 7, so that the separation wall 30 can be aligned with the grooved member 50 with the use of the referential pin 7 and the referential window 8.

First, the separation wall 30 is placed on the grooved member 50 in such a manner that each movable member 31 of the separation wall 30, comparable to a comb tooth, is fitted in the corresponding groove of the grooved member 50, which is to become the liquid flow path 14. Substantially at the same time, the contact type referential pin 7 of the grooved member 50 is inserted into the contact type referential window 8 of the separation wall 30. Then, the edge of the contact type referential window 8 is placed in contact with the contact type referential pin 7 of the grooved member 50 to desirably position the separation wall 30 relative to the grooved member 50.

As described above, according to the present invention, a liquid ejection head employs a pivotally movable member to eject liquid based on an innovative ejection principle. Also, in order to accurately align a separation wall with an element substrate when joining them, all that is necessary is to place the contact type positioning reference of the separation wall in contact with the contact type positioning reference of the element substrate, and therefore, accurate positioning can be done with the use of a small, simple, and inexpensive apparatus. Further, the liquid adjacent to an ejection outlet can be effectively ejected due to the synergistic effect from bubble growth and the pivotal movement of a movable member caused by the bubble growth, and therefore, ejection efficiency is improved compared with the conventional bubble jet system, conventional ejection method, conventional head, or the like.

Other Embodiment

In the foregoing, the description has been made as to the major parts of the liquid ejecting head and the liquid ejecting method according to the embodiments of the present invention. The description will now be made as to further detailed embodiments usable with the foregoing embodiments. The following examples are usable with both of the single-flow-path type and two-flow-path type without specific statement.

Referring to FIG. 14, the description will be made as to the operation of the liquid ejecting head according to this embodiment.

In this case, the bubble generation liquid supplied to the second liquid flow path 16 and the ejection liquid supplied to the first liquid flow path 14 were both water type ink.

By the heat generated by the heat generating element 2, the bubble generation liquid in the bubble generation region in the second liquid flow path generates a bubble 40, by film boiling phenomenon as described hereinbefore.

In this embodiment, the bubble generation pressure is not released in the three directions except for the upstream side in the bubble generation region, so that pressure produced by the bubble generation is propagated concentratedly on the movable member 6 side in the ejection pressure generation portion, by which the movable member 6 is displaced from the position indicated in FIG. 14, (*a*) toward the first liquid flow path side as indicated in FIG. 14, (*b*) with the growth of the bubble.

Similarly to the foregoing embodiment, when the movable member 31 is displaced as a result of the generation of the bubble, and the movable member 31 receives the resistance in the direction opposite from the displacement, but the resistance is sufficiently small as compared with the case in which the fulcrum of the movable member 31 is in the first liquid flow path 14 as in FIG. 14(*c*). Additionally, the refilling property is good, so the high viscosity liquid can be ejected.

By the operation of the movable member, the first liquid flow path 14 and the second liquid flow path 16 are in wide fluid communication with each other, and the pressure produced by the generation of the bubble is mainly propagated toward the ejection outlet in the first liquid flow path (direction A). By the propagation of the pressure and the mechanical displacement of the movable member, the liquid is ejected through the ejection outlet.

Figure 17:
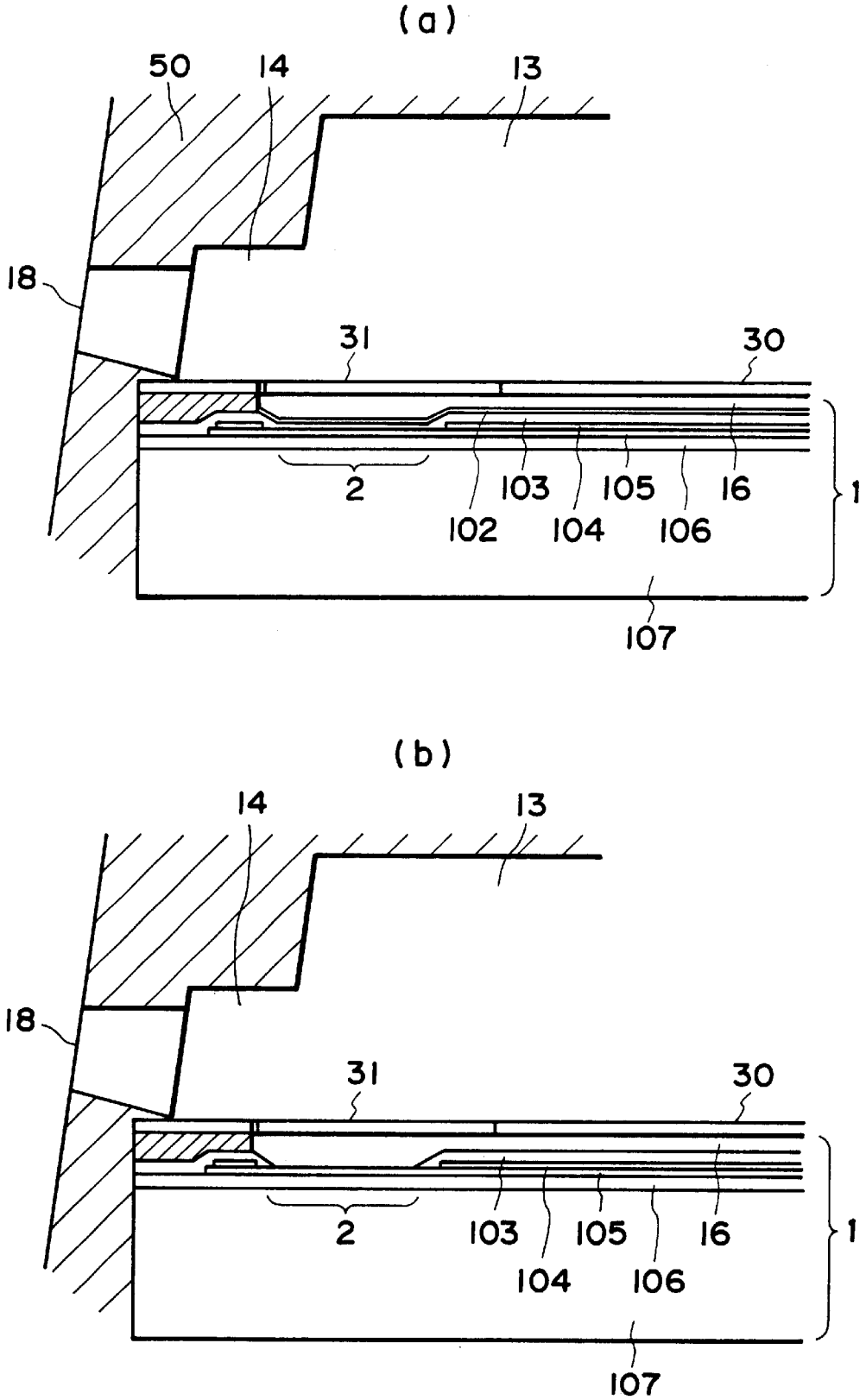
FIGS. 17(*a*) and 17(*b*) are longitudinal sectional views of a liquid ejecting head of the present invention.
Figure 18:
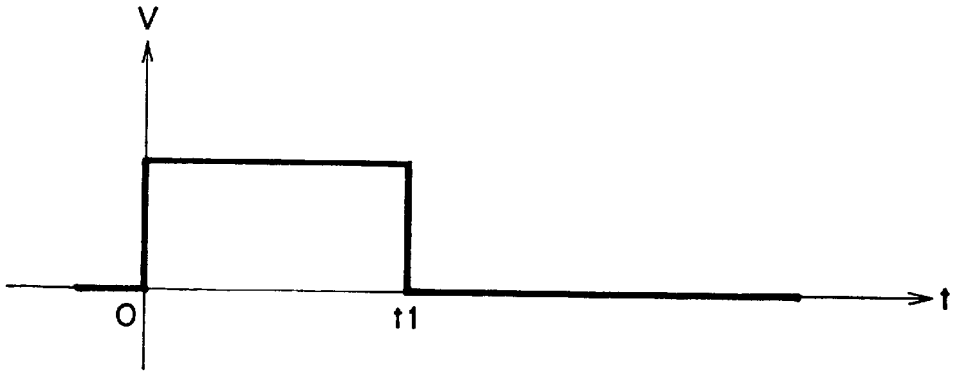
FIG. 18 is a schematic view showing a configuration of a driving pulse.

Then, with the contraction of the bubble, the movable member 31 returns to the position indicated in FIG. 17, (*a*), and correspondingly, an amount of the liquid corresponding to the ejection liquid is supplied from the upstream in the first liquid flow path 14. In this embodiment, the direction of the liquid supply is codirectional with the closing of the movable member as in the foregoing embodiments, the refilling of the liquid is not impeded by the movable member.

<Movable Member and Separation Wall>

Figure 20:
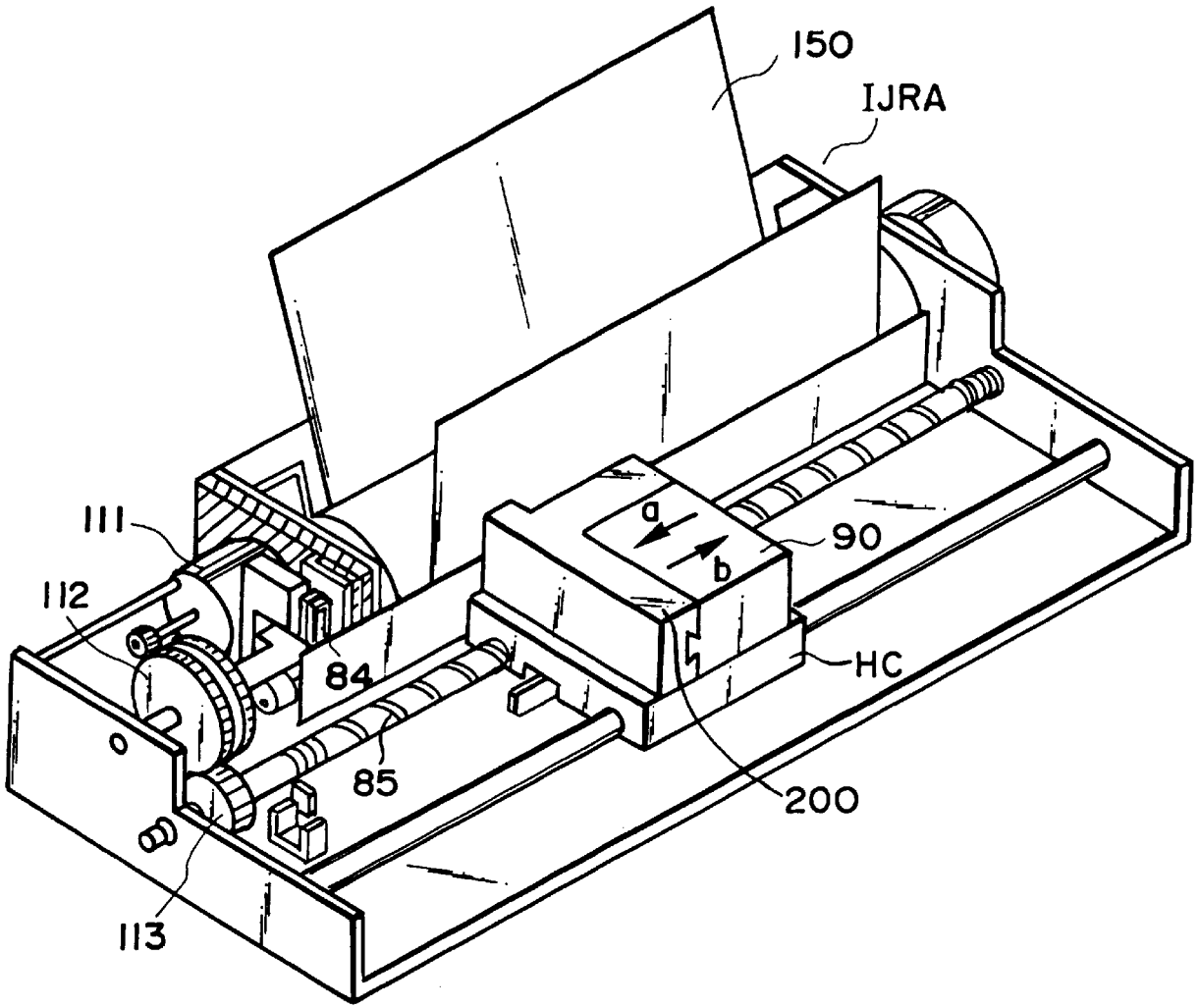
FIG. 20 is a schematic illustration of a liquid ejecting apparatus.
Figure 21:
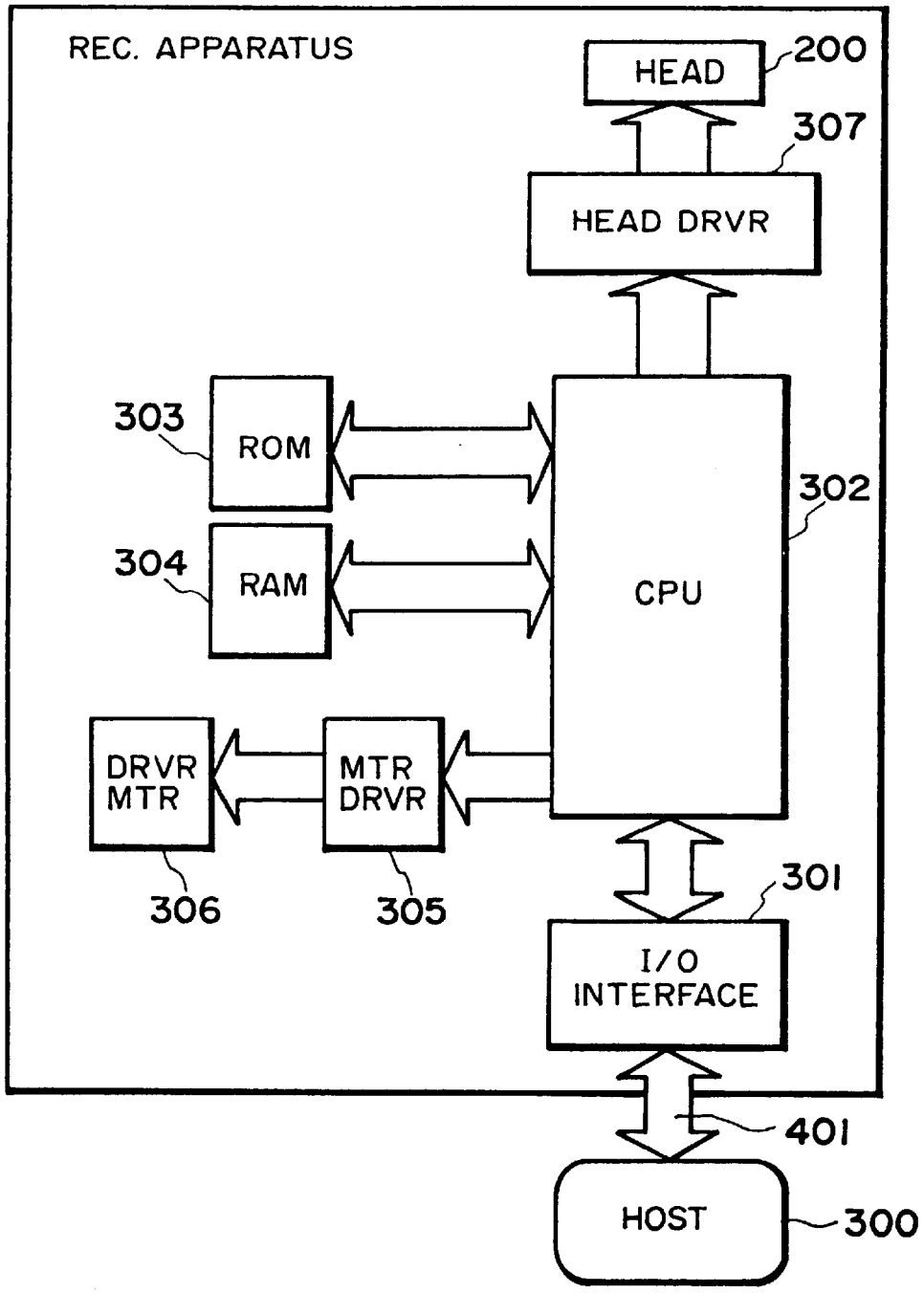
FIG. 21 is a block Figure of an apparatus.

FIG. 21 shows another example of the movable member 31, wherein reference numeral 35 designates a slit formed in the partition wall, and the slit is effective to provide the movable member 31. In the FIG., (*a*), the movable member has a rectangular configuration, and in (*b*), it is narrower in the fulcrum side to permit increased mobility of the movable member, and in (*c*), it has a wider fulcrum side to enhance the durability of the movable member. The configuration narrowed and arcuated at the fulcrum side is desirable as shown in FIG. 20, (*a*), since both of easiness of motion and durability are satisfied. However, the configuration of the movable member is not limited to the one described above, but it may be any if it does not enter the second liquid flow path side, and motion is easy with high durability.

In the foregoing embodiments, the plate or film movable member 31 and the separation wall 5 having this movable member was made of a nickel having a thickness of 5 $\mu$m, but this is not limited to this example, but it may be any if it has anti-solvent property against the bubble generation liquid and the ejection liquid, and if the elasticity is enough to permit the operation of the movable member, and if the required fine slit can be formed.

The thickness of the separation wall is determined depending on the used material and configuration from the standpoint of sufficient strength as the wall and sufficient operativity as the movable member, and generally, 0.5 μm–10 μm approx. is desirable.

The width of the slit 35 for providing the movable member 31 is 2 μm in the embodiments. When the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 μm approx. Slit is enough to avoid the liquid mixture, but not more than 3 μm is desirable.

In this invention, the movable member has a thickness of μm order as preferable thickness, and a movable member having a thickness of cm order is not used in usual cases. When the movable member having a thickness of the order of microns, and the slit width is also of the order of microns, a certain degree of consideration is to be paid to the manufacturing variation.

When the thickness of the member opposed to the free end and/or lateral edge of the movable member formed by a slit, is equivalent to the thickness of the movable member (FIGS. 13, 14 or the like), the relation between the slit width and the thickness is preferably as follows in consideration of the variation in the manufacturing to stably suppress the liquid mixture between the bubble generation liquid and the ejection liquid. When the bubble generation liquid has a viscosity not more than 3 cp, and a high viscous ink (5 cp, 10 cp or the like) is used as the ejection liquid, the mixture of the 2 liquids can be suppressed for a long term if $W/t \leqq 1$ is satisfied.

The slit providing the "substantial sealing", preferably has several microns width, since the liquid mixture prevention is assured.

When the bubble generation liquid and the ejection liquid are used for the respective functions, the movable member functions as a separation member in effect. When the movable member moves due to the generation of the bubble, a small amount of the bubble generation liquid may be mixed into the ejection liquid. Since the ejection liquid for forming an image usually contains approximately 3% to 5% of coloring agent, no significant density change occurs even if the content of the bubble generation liquid in the ejected droplet is not more than 20%. Such a case is within the split of the present invention, therefore.

In the foregoing embodiments, the maximum mixture ratio of the bubble generation liquid was 15% even when various viscosities are used. With the bubble generation liquid having the viscosity not more than 5 cps, the mixture ratio was 10% approx. at the maximum, although it is different if the driving frequency is different.

The mixed liquid can be reduced by reducing the viscosity of the ejection liquid in the range below 20 cps (for example not more than 5%).

The description will be made as to positional relation between the heat generating element and the movable member in this head. The configuration, dimension and number of the movable member and the heat generating element are not limited to the following example. By an optimum arrangement of the heat generating element and the movable member, the pressure upon bubble generation by the heat generating element, can be effectively used as the ejection pressure.

In a conventional bubble jet recording method, energy such as heat is applied to the ink to generate instantaneous volume change (generation of bubble) in the ink, so that ink is ejected through an ejection outlet onto a recording material to effect printing. In this case, the area of the heat generating element and the ink ejection amount are proportional to each other. However, there is a non-bubble-generation region S not contributable to the ink ejection. This fact is confirmed from observation of burnt deposit on the heat generating element, that is, the non-bubble-generation area S extends in the marginal area of the heat generating element. It is understood that marginal approx. 4 μm width is not contributable to the bubble generation.

In order to effectively use the bubble generation pressure, it is preferable that movable range of the movable member covers the effective bubble generating region of the heat generating element, namely, the inside area beyond the marginal approx. 4 μm width. In this embodiment, the effective bubble generating region is approx. 4 μm and inside thereof, but this is different if the heat generating element and forming method is different.

<Element Substrate>

The description will be made as to a structure of the element substrate provided with the heat generating element for heating the liquid.

FIG. 22 is a longitudinal section of the liquid ejecting head according to an embodiment of the present invention.

On the element substrate 1, a grooved member 50 is mounted, the member 50 having second liquid flow paths 16, separation walls 30, first liquid flow paths 14 and grooves for constituting the first liquid flow path.

The element substrate 1 has, as shown in FIG. 12, patterned wiring electrode (0.2–1.0 μm thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 μm thick is provided on the resistance layer, and in addition, an anti-cavitation layer of tantalum or the like (0.1–0.6 μm thick) is formed thereon to protect the resistance layer 105 from various liquid such as ink.

The pressure and shock wave generated upon the bubble generation and collapse is so strong that durability of the oxide film which is relatively fragile is deteriorated. Therefore, metal material such as tantalum (Ta) or the like is used as the anti-cavitation layer.

The protection layer may be omitted depending on the combination of liquid, liquid flow path structure and resistance material. One of such examples is shown in FIG. 17, (*b*). The material of the resistance layer not requiring the protection layer, includes, for example, iridium-tantalum-aluminum alloy or the like.

Thus, the structure of the heat generating element in the foregoing embodiments may include only the resistance layer (heat generation portion) or may include a protection layer for protecting the resistance layer.

In the embodiment, the heat generating element has a heat generation portion having the resistance layer which generates heat in response to the electric signal. This is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selectively driving the electrothermal transducer element may also be integrally built in, in addition to the resistance layer 105 constituting the heat generation portion and the electrothermal transducer constituted by the wiring electrode 104 for supplying the electric signal to the resistance layer.

In order to eject the liquid by driving the eat generation portion of the electrothermal transducer on the above-described element substrate 1, the resistance layer 105 is supplied through the wiring electrode 104 with rectangular pulses as shown in FIG. 23 to cause instantaneous heat generation in the resistance layer 105 between the wiring electrode. In the case of the heads of the foregoing embodiments, the applied energy has a voltage of 24 V, a pulse width of 7 $\mu$sec, a current of 150 mA and a frequency of 6 kHz to drive the heat generating element, by which the liquid ink is ejected through the ejection outlet through the process described hereinbefore. However, the driving signal conditions are not limited to this, but may be any if the bubble generation liquid is properly capable of bubble generation.

<Ejection Liquid and Bubble Generation Liquid>

As described in the foregoing embodiment, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that ejection liquid by itself or by reaction with the bubble generation liquid, does not impede the ejection, the bubble generation or the operation of the movable member or the like.

As for the recording ejection liquid, high viscous ink or the like is usable. As for another ejection liquid, pharmaceuticals and perfume or the like having a nature easily deteriorated by heat is usable.

The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded.

| Dye ink viscosity of 2 cp | |
|---|---|
| (C.I. Food black 2) dye | 3 wt. % |
| Ethylene glycol | 10 wt. % |
| Thiodiglycol | 5 wt. % |
| Ethanol | 5 wt. % |
| Water | 77 wt. % |

Recording operations were also carried out using the following combination of the liquids for the bubble generation liquid and the ejection liquid. As a result, the liquid having ten cps viscosity, which was unable to be ejected heretofore, was properly ejected, and even 150 cps liquid was properly ejected to provide high quality image.

| | |
|---|---|
| Bubble generation liquid 1: | |
| Ethanol | 40 wt. % |
| Water | 60 wt. % |
| Bubble generation liquid 2: | |
| Water | 100 wt. % |
| Bubble generation liquid: | |
| Isopropyl alcohol | 10 wt. % |
| Water | 10 wt. % |
| Ejection liquid 1 (Pigment ink; approx. 15 cp): | |
| Carbon black | 5 wt. % |
| Stylene-acrylate-acrylate ethyl copolymer resin material dispersion material (oxide = 140, weight average molecular weight = 8000) | 1 wt. % |
| Mono-ethanol amine | 0.25 wt. % |
| Glyceline | 69 wt. % |
| Thiodiglycol | 5 wt. % |
| Ethanol | 3 wt. % |
| Water | 16.75 wt. % |
| Ejection liquid 2 (55 cp): | |
| Polyethylene glycol 200 | 100 wt. % |
| Ejection liquid 3 (55 cp): | |
| Polyethylene glycol 600 | 100 wt. % |

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

<Head Structure for 2 Flow Path>

Figure 19:
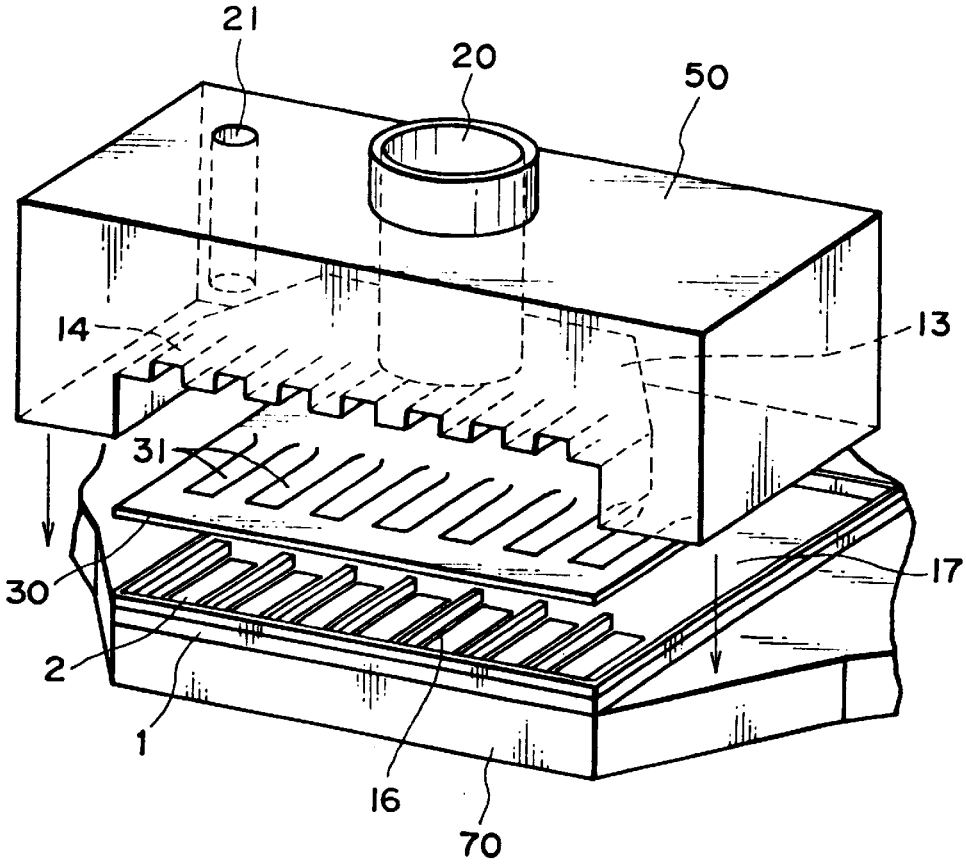
FIG. 19 is an exploded perspective view of a head of the present invention.

FIG. 19 is an exploded perspective view of a two-flow-path structure head according to an embodiment of the present invention.

The element substrate 1 is disposed on a supporting member 70 of aluminum or the like. A wall for the second liquid flow path 16 and a wall for the second common liquid chamber 17, thereon, and a separation wall 30 having the movable member 31 is provided further thereon. There is further provided, on the separation wall 30, a grooved member 50 including a plurality of grooves for constituting the first liquid flow paths 14, the first common liquid chamber 13, the supply passage 20 for supplying the first liquid to the first common liquid chamber 13, and the supply passage 21 for supplying the second liquid to the second common liquid chamber 17, thus constituting two-path head.

<Liquid Ejecting Device>

FIG. 20 is a schematic illustration of a liquid ejecting device used with the above-described liquid ejecting head. In this example, the ejection liquid is ink. The apparatus is an ink ejection recording apparatus. The liquid ejecting device comprises a carriage HC to which the head cartridge comprising a liquid container portion 90 and liquid ejecting head portion 201 which are detachably connectable with each other, is mountable. The carriage HC is reciprocable in a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head 201 in response to the signal.

The liquid ejecting apparatus of this embodiment comprises a motor 111 as a driving source for driving the recording material transporting means and the carriage, gears 112, 113 for transmitting the power from the driving source to the carriage, and carriage shaft 115 and so on. By the recording device and the liquid ejecting method using this recording device, good prints can be provided by ejecting the liquid to the various recording material.

FIG. 21 is a block diagram of the entirety of the device for carrying out ink ejection recording using the liquid ejecting head and the liquid ejecting method of the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following-control programs stored in a ROM 303.

The CPU 302 processes the aforementioned data inputted to the CPU 302, into printable data (image data), by processing them with the use of peripheral units such as RAMs 304 or the like, following control programs stored in a ROM 303. The image data and the motor driving data are transmitted to a head 200 and a driving motor 306 through a head driver 307 and a motor driver 305, respectively, which are controlled with the proper timings for forming a image.

As for recording material, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording material such as sponge or the like, a textile printing apparatus for recording images on fabric, and the like recording apparatuses.

As for the ejection liquid usable with the liquid ejecting apparatus, it is selected properly by skilled in the art, in consideration of the recording material and the recording condition.

The present invention is applicable to a so-called side shooter type head, wherein the liquid is ejected in a direction perpendicular the heater surface.

According to an aspect of the present invention, the fulcrum is provided in the first common chamber, so that produced pressure is efficiently directed toward the ejection outlet. In addition, the influence of the back-wave can be suppressed, thus minimizing the flow resistance of the first liquid passage. Thus, the refiling of the liquid is improved, and the high ejection efficiency and high ejection pressure can be provided. The first liquid flow path for the ejection of the liquid and the second liquid flow path for the generation of the bubble, and the portion where the bubble is generated is in the form of a chamber, so that bubble generation efficiency is improved, and the above advantage is further enhanced.

According to the structure using the ejection principle, the synergetic effect of the bubble and the movable member is provided so that liquid adjacent the ejection outlet can be ejected efficiently, thus improving the ejection efficiency.

The ejection failure can be avoided even after long term non-use under low temperature and low humidity conditions, and even if the ejection failure occurs, the normal state is restored by small scale refreshing process such as preliminary ejection or suction recovery. According to the present invention, the time required for the recovery can be reduced, and the loss of the liquid by the recovery operation is reduced, so that running cost can be reduced.

In an aspect of improving the refilling property, the responsivity, the stabilized growth of the bubble and stabilization of the liquid droplet during the continuous ejections are accomplished, thus permitting high speed recording.

By the comb-like configuration of the movable member, the accuracy of connection is assured in the direction of the liquid flow path, thus permitting easy and less expensive manufacturing of the liquid ejecting head.

With the head of the two-flow-path structure, the latitude of selection of the ejection liquid is wide since the bubble generation liquid may be the one with which the bubble generation is easy and with which the deposited material (burnt deposit or the like) is easily produced. Therefore, the liquids which have not been easily ejected through the conventional bubble jet ejecting method, such as high viscosity liquid with which bubble generation is difficult or a liquid which tends to produce burned deposit on the heater, can be ejected in good order.

Furthermore, a liquid which is easy influenced by heat can be ejected without adverse influence.

Accordingly, the liquid which has to be painted because of its high viscosity can be printed as dots.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejection head comprising:

a plurality of ejection outlets for ejecting a liquid;

a plurality of liquid flow paths in fluid communication with said ejection outlets;

a plurality of bubble generating regions for generating bubbles;

a movable member disposed faced to said bubble generating regions and movable between a first position and a second position which is farther from said bubble generating region than the first position; wherein said movable member moves from said first position to said second position by pressure produced by the generation of the bubble to permit expansion of the bubble more in a downstream side closer to the ejection outlet than in an upstream side; and a first common liquid chamber in fluid communication with said liquid flow paths, having a height, measured in a direction perpendicular to a plane including said movable member at rest, which is larger than that of said liquid flow paths, wherein said movable member has a fulcrum in said first common liquid chamber and a free end in said liquid flow paths.

2. A liquid ejection head according to claim 1, wherein said free end of said movable member is contacted to a top of said liquid flow paths when said movable member is moved to its maximum.

3. A liquid ejection head according to claim 1, wherein each said liquid flow path is downstream of said free end when said movable member is moved to its maximum.

4. A liquid ejection head according to claim 1, wherein a downstream portion of said bubble grows downstream of said movable member by the displacement of said movable member.

5. A liquid ejection head according to claim 1, wherein said free end is downstream of said fulcrum.

6. A liquid ejection head according to claim 1, wherein said movable member has a comb-like portion.

7. A liquid ejection head comprising:

a plurality of ejection outlets for ejecting a liquid;

a plurality of liquid flow paths each having a heat generating element for generating a bubble in the liquid by application of heat to the liquid, and a supply passage for supplying the liquid to the heat generating element from upstream side thereof;

a movable member, disposed faced to said heat generating elements and having a free end adjacent said ejection outlet, for directing a pressure produced by generation of the bubble, toward said ejection outlet, on the basis of the pressure produced by the generation of the bubble; and a first common liquid chamber in fluid communication with said liquid flow paths, having a height, measured in a direction perpendicular to a plane including said movable member at rest, which is larger than that of said liquid flow paths, wherein said movable member has a fulcrum in said first common liquid chamber and a free end in said liquid flow paths.

8. A liquid ejection head according to claim 7, wherein said free end of said movable member is contacted to a top of said liquid flow path when said movable member is moved to its maximum.

9. A liquid ejection head according to claim 7, wherein said liquid flow path is downstream of said free end when said movable member is moved to its maximum.

10. A liquid ejection head according to claim 7, wherein said movable member has a comb-like portion.

11. A liquid ejection head comprising:

a plurality of ejection outlets for ejecting a liquid;

a plurality of liquid flow paths in fluid communication with said ejection outlets;

a plurality of heat generating elements for generating bubbles in the liquid by application of heat to the liquid;

a movable member, disposed faced to said heat generating elements and having a free end adjacent to said ejection outlets, for directing a pressure produced by generation of the bubble, toward said ejection outlet;

a supply passage for supplying the liquid to said heat generating elements from an upstream thereof along a surface of said movable member adjacent said heat generating elements;

a first common liquid chamber in fluid communication with said liquid flow paths, having a height, measured in a direction perpendicular to a plane including said movable members at rest, which is larger than that of said liquid flow paths, wherein each said movable member has a fulcrum in said first common liquid chamber and a free end in said liquid flow paths.

12. A liquid ejection head according to claim 11, wherein said free end of said movable member is contacted to a top of said liquid flow paths when said movable member is moved to its maximum.

13. A liquid ejection head according to claim 11, wherein said liquid flow path is downstream of said free end when said movable member is moved to its maximum.

14. A liquid ejection head according to claim 11, wherein said movable member has a comb-like portion.

15. A liquid ejection head comprising:

a plurality of first liquid flow paths in fluid communication with a plurality of ejection outlets;

a plurality of second liquid flow paths each having a bubble generation region for generating bubbles in a liquid by applying heat to the liquid;

a movable member, disposed between each of said first liquid flow paths and an associated one of said bubble generating regions and having a free end adjacent said ejection outlet, for directing a pressure produced by generation of the bubble, toward said ejection outlet of said first liquid flow path, by movement of the free end into said first liquid flow path on the basis of pressure produced by generation of the bubble in the bubble generating region;

a first common liquid chamber in fluid communication with said first liquid flow paths, having a height, measured in a direction perpendicular to a plane including said movable member at rest, which is larger than that of said first liquid flow path, wherein said movable member has a fulcrum in said first common liquid chamber and a free end in said first liquid flow path.

16. A liquid ejection head according to claim 15, wherein said free end of said movable member is contacted to a top of said first liquid flow path when said movable member is moved to its maximum.

17. A liquid ejection head according to claim 15, wherein said first liquid flow path is downstream of said free end when said movable member is moved to its maximum.

18. A liquid ejection head according to claim 15, further comprising a heat generating element at a position faced to said movable member, and said bubble generating region is defined by said movable member and said heat generating element.

19. A liquid ejection head according to claim 18, wherein said free end of said movable member is disposed downstream of a center of an area of said heat generating element.

20. A liquid ejection head according to claim 18, further comprising a supply passage for supplying the liquid to said heat generating element from an upstream of said heat generating element along a surface of said heat generating element.

21. A liquid ejection head according to claim 18, wherein said supply passage has a substantially flat inner wall, and the liquid is supplied to said heat generating element along the inner wall.

22. A liquid ejection head according to claim 18, wherein said bubble is generated by film boiling caused by heat generated by said heat generating element.

23. A liquid ejection head according to claim 18, wherein said movable member is in the form of a plate.

24. A liquid ejection head according to claim 23, wherein all of an effective bubble generation region of said heat generating element is faced to said movable member.

25. A liquid ejection head according to claim 23, wherein a whole surface of said heat generating element is faced to said movable member.

26. A liquid ejection head according to claim 23, wherein a total area of said movable member is larger than a total area of said heat generating element.

27. A liquid ejection head according to claim 23, wherein a fulcrum of said movable member is right above said heat generating element.

28. A liquid ejection head according to claim 23, wherein the free end of said movable member is extended in a direction substantially perpendicular to the liquid flow path in which said heat generating element is disposed.

29. A liquid ejection head according to claim 23, wherein said free end of said movable member is closer to said ejection outlet than said heat generating element.

30. A liquid ejection head according to claim 15, wherein said movable member constitutes a part of a separation wall between said first flow path and second flow path.

31. A liquid ejection head according to claim 30, wherein said separation wall comprises a metal material.

32. A liquid ejection head according to claim 31, wherein said metal material comprises nickel.

33. A liquid ejection head according to claim 30, wherein said separation wall comprises a resin material.

34. A liquid ejection head according to claim 30, wherein said separation wall comprises a ceramic.

35. A liquid ejection head according to claim 15, wherein said first common liquid chamber supplies a first liquid to a plurality of said first liquid flow paths, and said liquid ejection head further comprising a second common liquid chamber for supplying a second liquid to a plurality of said second liquid flow paths.

36. A liquid ejection head according to claim 15, wherein said movable member has a comb-like portion.

37. A liquid ejection head, comprising:

a grooved member having a plurality of ejection outlets through which a liquid is ejected, a plurality of grooves for constituting a plurality of first liquid flow paths in direct fluid communication with associated ones of said ejection outlets, and a recess for constituting a first common liquid chamber for supplying the liquid to said first liquid flow paths, an element substrate having a plurality of heat generating elements for generating bubbles in the liquid by applying heat to the liquid; and a partition wall disposed between said grooved member and said element substrate and forming a part of walls of second liquid flow paths corresponding to said heat generating elements, and a movable member movable into said first liquid flow paths by pressure produced by the generation of the bubble, said movable member being faced to each of said heat generating elements; and a first common liquid chamber in fluid communication with said first liquid flow paths, having a height, measured in a direction perpendicular to a plane including said movable member at rest, which is larger than that of said first liquid flow path, wherein said movable member has a fulcrum in said first common liquid chamber and a free end in said first liquid flow path.

38. A liquid ejection head according to claim 37, wherein said free end of said movable member is contacted to a top of said first liquid flow path when said movable member is moved to its maximum.

39. A liquid ejection head according to claim 37, wherein said first liquid flow path is downstream of said free end when said movable member is moved to its maximum.

40. A liquid ejection head according to claim 37, wherein said free end of said movable member is disposed downstream of a center of an area of said heat generating element.

41. A liquid ejection head according to claim 37, wherein said grooved member has a first introduction path for introducing the liquid to said first common liquid chamber, and a second introduction path for introducing the liquid to said second common liquid chamber.

42. A liquid ejection head according to claim 41, wherein said grooved member has a plurality of said second introduction paths.

43. A liquid ejection head according to claim 41, wherein a ratio between a cross-sectional area of said first introduction path and a cross-sectional area of said second introduction path is proportional to a supply amounts of the respective liquids.

44. A liquid ejection head according to claim 41, wherein said second introduction path penetrates said separation wall to supply the liquid to said second common liquid chamber.

45. A liquid ejection head according to claim 15, wherein the liquid supplied to said first liquid flow path is the same as the liquid supplied to said second liquid flow path.

46. A liquid ejection head according to claim 15, wherein the liquid supplied to said first liquid flow path is different from the liquid supplied to said second liquid flow path.

47. A liquid ejection head according to claim 46, wherein the liquid in said second liquid flow path is at least lower in viscosity, higher in bubble generation property, higher in thermal stability than the liquid in said first liquid flow path.

48. A liquid ejection head according to claim 15, wherein said heat generating element is an electrothermal transducer having a heat generating resistor generating heat upon application of electric signal thereto.

49. A liquid ejection head according to claim 48, wherein said electrothermal transducer has a protecting film on said heat generating resistor.

50. A liquid ejection head according to claim 48, wherein on said element substrate, there are provided wiring for transmitting an electric signal to said electrothermal transducer, and a function element for selectively applying an electric signal to said electrothermal transducer.

51. A liquid ejection head according to claim 15, wherein a portion of said second liquid flow path where said bubble generating region or heat generating element are disposed has a chamber-like configuration.

52. A liquid ejection head according to claim 15, wherein said second liquid passage has a throat-like portion upstream of said bubble generating region or heat generating element.

53. A liquid ejection head according to claim 15, wherein a distance between a surface of said heat generating element and said movable member is not more than 30 $\mu$m.

54. A liquid ejection head according to claim 15, wherein the liquid ejected through said ejection outlet is ink.

55. A liquid ejection head according to claim 37, wherein said movable member has a comb-like portion.

56. A recording method comprising the steps of:

providing a liquid ejection head according to any of claims 1, 7, 11, 15 and 37; and recording on a recording medium using the liquid ejection head.

57. A liquid ejection apparatus, comprising:

a liquid ejection head according to any of claims 1, 7, 11, 15 and 37; and driving signal supply means for supplying a driving signal to the liquid ejection head so that the liquid is ejected from said liquid ejecting head onto a recording material.

58. A liquid ejection apparatus comprising:

a liquid ejection head according to any of claims 1, 7, 11, 15 and 37; and recording material feeding means for feeding a recording material past the liquid ejection head to receive the liquid ejected from said liquid ejecting head.

59. A liquid ejection apparatus according to claim 57, wherein the liquid is ink, and said recording material is recording paper.

60. A liquid ejection apparatus according to claim 57, wherein the recording material is a textile.

61. A liquid ejection apparatus according to claim 57, wherein the recording material is plastic resin material.

62. A liquid ejection apparatus according to claim 57, wherein the liquid is recording liquid, and the recording material is metal.

63. A liquid ejection apparatus according to claim 57, wherein the liquid is recording liquid, and the recording material is wood.

64. A liquid ejection apparatus according to claim 57, wherein the liquid is recording liquid, and the recording material is leather.

65. A liquid ejection apparatus according to claim 57, wherein a plurality of colors of recording liquid are ejected to effect color recording.

66. A liquid ejection apparatus according to claim 57, wherein said ejection outlets are arranged over an entire width of a recordable region of the recording material.

67. A liquid ejection apparatus according to claim 58, wherein the liquid is ink, and said recording material is recording paper.

68. A liquid ejection apparatus according to claim 58, wherein the recording material is a textile.

69. A liquid ejection apparatus according to claim 58, wherein the recording material is plastic resin material.

70. A liquid ejection apparatus according to claim 58, wherein the liquid is recording liquid, and the recording material is metal.

71. A liquid ejection apparatus according to claim 58, wherein the liquid is recording liquid, and the recording material is wood.

72. A liquid ejection apparatus according to claim 58, wherein the liquid is recording liquid, and the recording material is leather.

73. A liquid ejection apparatus according to claim 58, wherein a plurality of colors of recording liquid are ejected to effect color recording.

74. A liquid ejection apparatus according to claim 58, wherein said ejection outlets are arranged over an entire width of a recordable region of the recording material.

* * * * *

UNITED STATES PATENT AND TRADEMARK OFFICE

CERTIFICATE OF CORRECTION

PATENT NO. : 6,260,958 B1
DATED : July 17, 2001
INVENTOR(S) : Aya Yoshihira et al.

Figure 6:
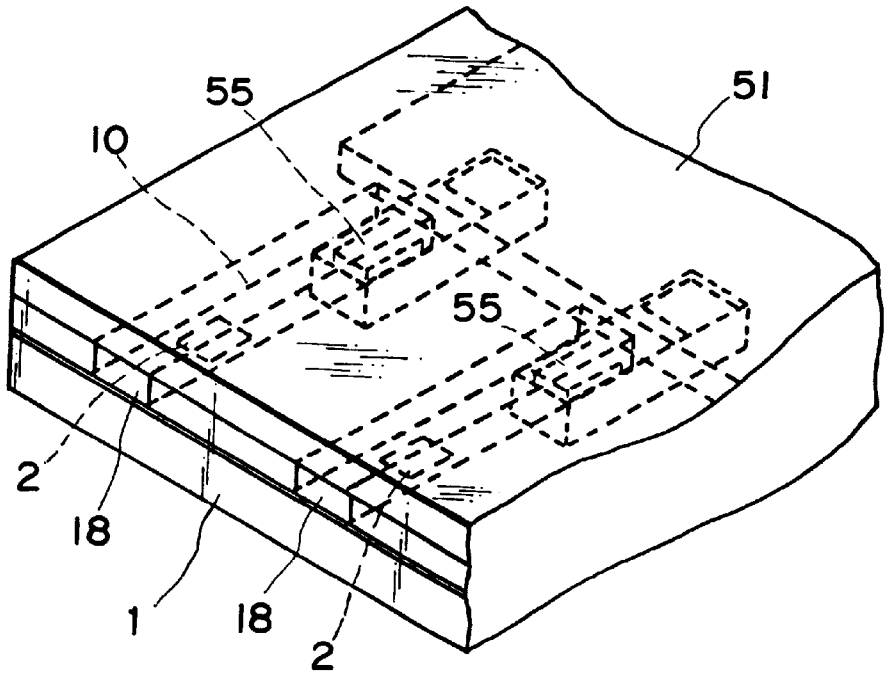
FIGS. 6(*a*) and 6(*b*) illustrate a flow passage structure of a conventional/liquid ejecting head.
Figure 6:
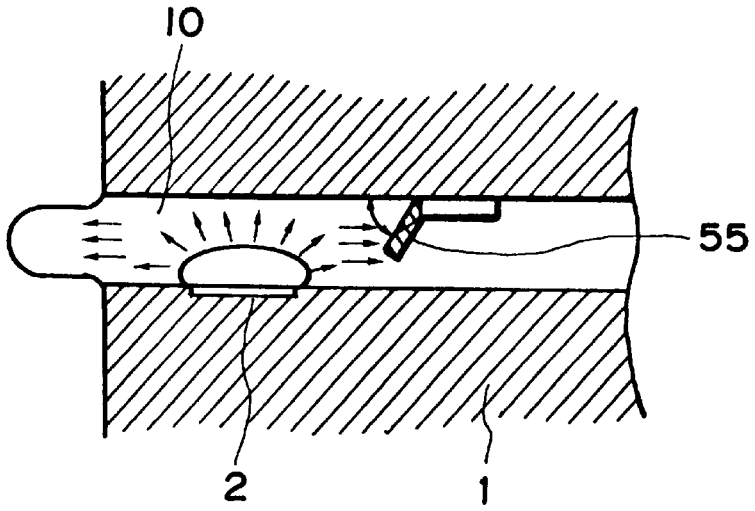

It is certified that error appears in the above-identified patent and that said Letters Patent is hereby corrected as shown below:

Column 1,
Line 5, “1997 Ser.” should read -- 1997, now Pat. --;
Line 30, “With such” should read -- Such --;
Line 37, “another” should read -- other --;
Line 57, “and so on” should be deleted; and
Line 64, “FIG. 6,” should read -- In FIG. 6, --.

Column 2,
Line 7, “improvement” should read -- improved --; and
Line 44, “the some” should read -- some --.

Column 3,
Line 28, “form” should read -- from --.

Column 5,
Line 19, “function” should read -- functions --;
Line 42, “view” should read -- views --;
Line 57, “a” should be deleted; and
Line 60, “Present” should read -- present --.

Column 6,
Line 27, “series” should read -- a series --;
Line 32, “is a” should read -- are --;
Line 37, “movable” should read -- a movable --;
Line 40, “FIG. 26 is shows” should read -- FIGS. 26(a)-26(c) show --;
Line 57, “is” should read -- is a --; and
Line 65, “is” should read -- is a --.

Column 7,
Line 3, “Second” should read -- A second --; and
Line 67, “(b) and (c) or in FIG. 2.” should be deleted.

Column 8,
Line 6, “principle” should read -- principles --;
Line 7, “movable” should read -- a movable --;
Line 15, “More” should read -- A more --;
Line 19, “VA,” should read -- $V_A$, --;
Line 21, “VB.” should read -- $V_B$. --; and
Line 26, “of the is” should read -- is --.

UNITED STATES PATENT AND TRADEMARK OFFICE

CERTIFICATE OF CORRECTION

PATENT NO. : 6,260,958 B1
DATED : July 17, 2001
INVENTOR(S) : Aya Yoshihira et al.

It is certified that error appears in the above-identified patent and that said Letters Patent is hereby corrected as shown below:

Column 9,
Line 33, “bubble, are” should read -- bubble is --; and
Line 50, “$VD_1$ and $VD_2$” should read -- $V_{D1}$ and $V_{D2}$ --.

Column 13,
Line 50, “elective” should read -- ejective --.

Column 14,
Line 12, “FIG. 22,” should read -- In FIG. 22, --;
Line 23, “formed” should read -- is formed --; and
Line 42, “can it” should read -- it can --.

Column 17,
Line 51, “bubbles. <Positional” should read -- bubbles. ¶<Positional --.

Column 19,
Line 22, “alloy” should read -- or alloys --; and
Line 47, “alloy” should read -- or alloys --.

Column 20,
Line 24, “is” should read -- is a --.

Column 21,
Line 25, “member 31” should read -- members 31 --.

Column 23,
Line 57, “Embodiment” should read -- Embodiments --.

Column 24,
Line 47, “FIG.,” should read -- Figure, --.

Column 26,
Line 45, “is” should read -- are --.

Column 27,
Line 9, “eat” should read -- heat --;
Line 15, “electrode.” should read -- electrodes. --; and
Line 45, “includes:” should read -- include: --.

UNITED STATES PATENT AND TRADEMARK OFFICE

CERTIFICATE OF CORRECTION

PATENT NO. : 6,260,958 B1
DATED : July 17, 2001
INVENTOR(S) : Aya Yoshihira et al.

It is certified that error appears in the above-identified patent and that said Letters Patent is hereby corrected as shown below:

Column 29,
Line 46, “following-control” should read -- following control --;
Line 54, “a” should read -- an --; and
Line 57, “listed;” should read -- listed: --.

Column 30,
Line 15, “perpendicular” should read -- perpendicular to --.

Column 32,
Line 14, “elements;” should read -- elements; and --; and
Line 45, “region;” should read -- region; and --.

Column 33,
Line 63, “liquid; and” should read -- liquid; --.

Column 34,
Line 31, “amounts” should read -- amount --; and
Line 60, “are” should read -- is --.

Signed and Sealed this

Twenty-ninth Day of October, 2002

*Attest:*

*Attesting Officer*

JAMES E. ROGAN
*Director of the United States Patent and Trademark Office*